US011293123B2

(12) United States Patent
Onodera et al.

(10) Patent No.: US 11,293,123 B2
(45) Date of Patent: Apr. 5, 2022

(54) WOVEN FABRIC

(71) Applicant: TOYOBO STC CO., LTD., Osaka (JP)

(72) Inventors: Tadato Onodera, Osaka (JP); Hajime Tone, Osaka (JP); Hideki Kawabata, Osaka (JP)

(73) Assignee: TOYOBO STC CO., LTD., Osaka (JP)

( * ) Notice: Subject to any disclaimer, the term of this patent is extended or adjusted under 35 U.S.C. 154(b) by 790 days.

(21) Appl. No.: 15/998,498

(22) Filed: Aug. 16, 2018

(65) Prior Publication Data

US 2019/0055682 A1 Feb. 21, 2019

(30) Foreign Application Priority Data

Aug. 16, 2017 (JP) ..... JP2017-157243

(51) Int. Cl.
*D03D 15/00* (2021.01)
*D03D 15/44* (2021.01)
(Continued)

(52) U.S. Cl.
CPC ..... *D03D 15/44* (2021.01); *D01D 5/253* (2013.01); *D01F 1/10* (2013.01); *D06P 3/241* (2013.01);
(Continued)

(58) Field of Classification Search
CPC ..... D03D 15/44; D01D 5/253; D01F 1/10; D06P 3/241; D06P 3/54; D06P 7/00
(Continued)

(56) References Cited

U.S. PATENT DOCUMENTS

| | | | | |
|---|---|---|---|---|
| 2005/0176323 | A1 | 8/2005 | Minato et al. | |
| 2015/0203997 | A1* | 7/2015 | Yamanaka | D03D 1/00 2/97 |
| 2016/0076173 | A1* | 3/2016 | Taninomiya | D02G 3/04 57/253 |

FOREIGN PATENT DOCUMENTS

| | | |
|---|---|---|
| JP | 7-70848 | 3/1995 |
| JP | 2004-52191 | 2/2004 |
| WO | 2014/021013 | 2/2014 |

* cited by examiner

*Primary Examiner* — Vincent Tatesure
(74) *Attorney, Agent, or Firm* — Wenderoth, Lind & Ponack, L.L.P.

(57) ABSTRACT

Provided is a down-proof woven fabric which is highly effective to prevent leakage of down from a seam of a product, even having a low cover factor, the woven fabric containing a single yarn having a convex portion and a concave portion in a cross section, in which an air permeability is 0.1 $cm^3/cm^2 \cdot s$ or more and 2.0 $cm^3/cm^2 \cdot s$ or less; a total fineness is 5 dtex or more and 80 dtex or less; a total cover factor of a warp and a weft is 1500 or more and 2200 or less; a hole is formed in the woven fabric with a sewing machine needle having a cross-sectional diameter (thickness of a main body of the sewing machine needle) of 1.00 mm, and in an area having a radius of 1.5 mm about the hole, a total number of warps and wefts that are displaced by 0.08 mm or more with the sewing machine needle is 3 or less at 15 minutes after the sewing machine needle is pulled out from the woven fabric; and the following characteristics:

(i) a fitting ratio of single yarns is 10% or more and 80% or less
(ii) a laminating rate of the single yarn is 0.4 or more and 3.0 or less
(iii) a number of convex portions of the single yarn is 2 or more and 12 or less (Continued)

(iv) the single yarn has a modification degree of 1.2 or more and 3.0 or less (v) a concave portion of the single yarn has a depth of 0.6 μm or more and 8 μm or less $$CF=CF_T+CF_W$$

where CF represents the total cover factor of the warp and the weft; $CF_T$ represents a cover factor of the warp; and $CF_W$ represents the cover factor of the weft.

16 Claims, 16 Drawing Sheets

(51) Int. Cl.

| | |
|---|---|
| ***D01D 5/253*** | (2006.01) |
| ***D01F 1/10*** | (2006.01) |
| ***D06P 3/54*** | (2006.01) |
| ***D06P 7/00*** | (2006.01) |
| ***D06P 3/24*** | (2006.01) |
| *D01F 6/60* | (2006.01) |
| *A41D 31/00* | (2019.01) |
| *D01F 6/62* | (2006.01) |

(52) U.S. Cl.
CPC ..... *D06P 3/54* (2013.01); *D06P 7/00* (2013.01); *A41D 31/00* (2013.01); *D01F 6/60* (2013.01); *D01F 6/62* (2013.01); *D06M 2200/12* (2013.01); *D10B 2501/04* (2013.01)

(58) Field of Classification Search
USPC ..... 442/192
See application file for complete search history.

【Fig. 1】
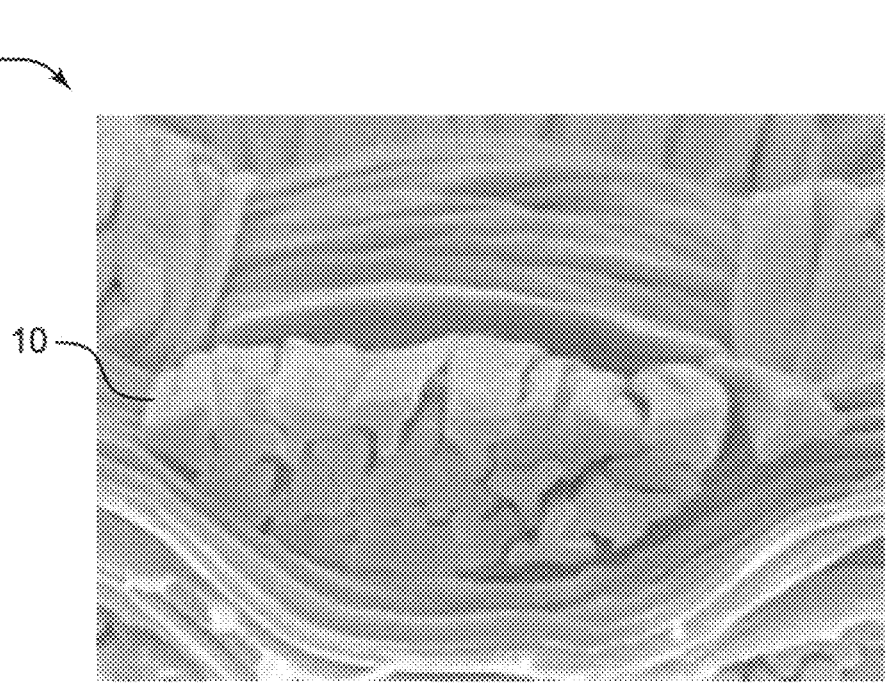

【Fig. 2】
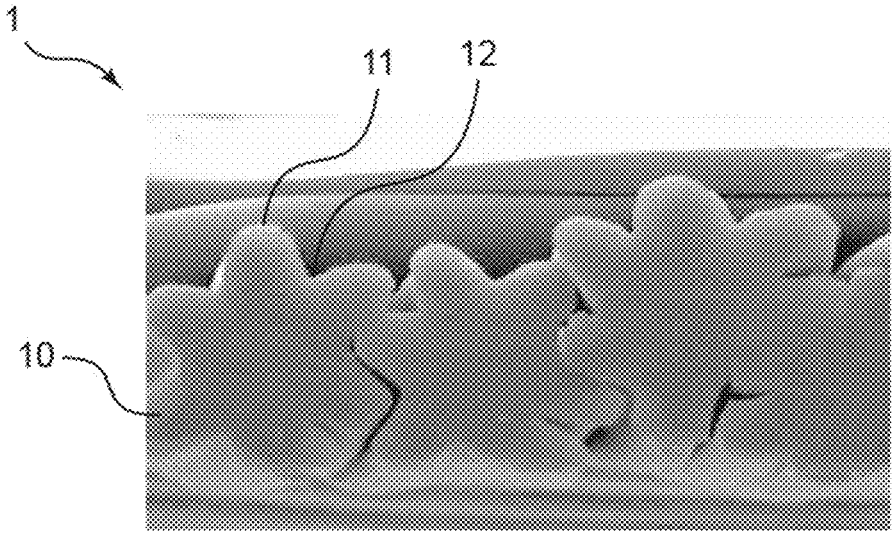

【Fig. 3】
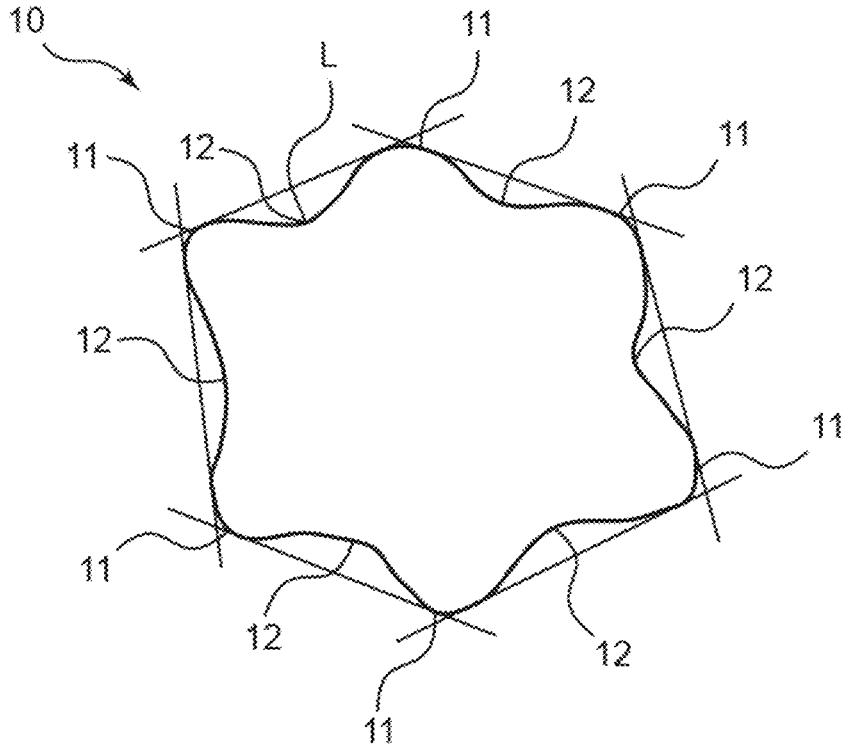

【Fig. 4】
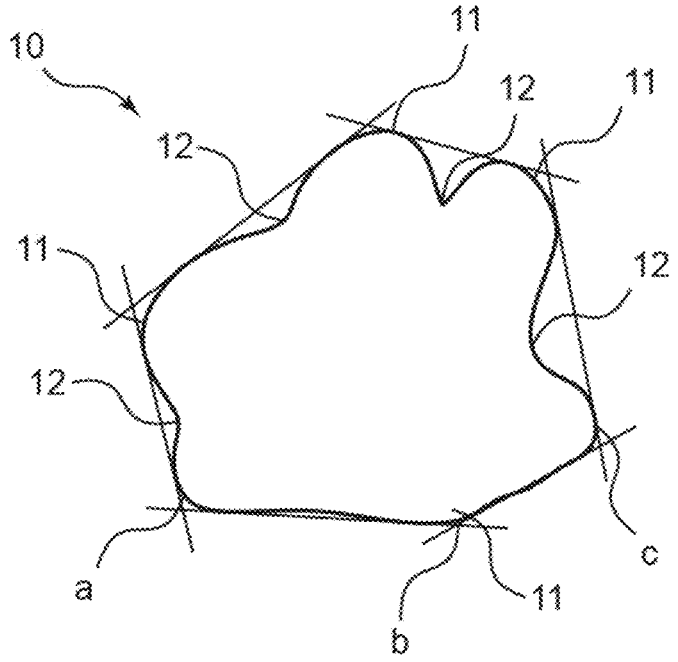

【Fig. 5】
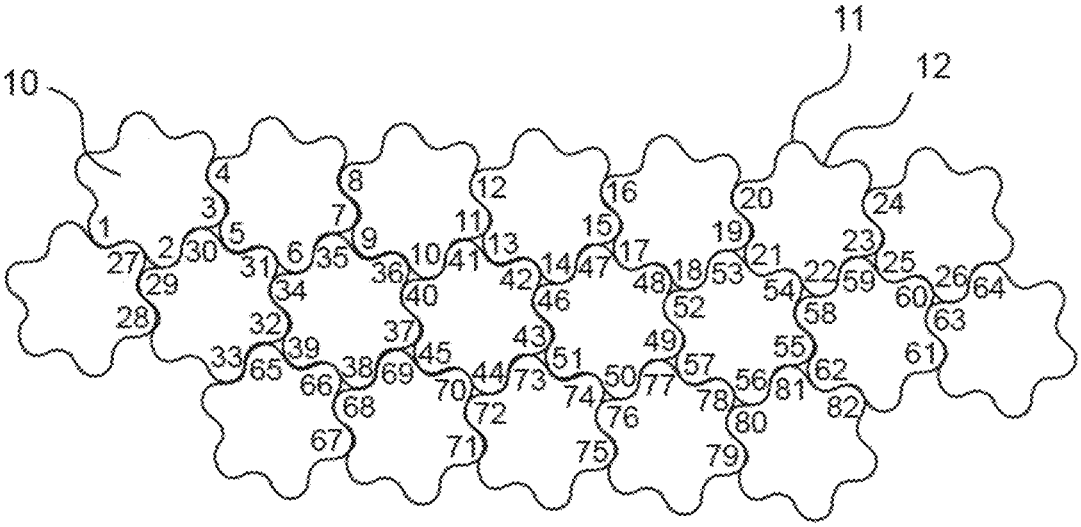

【Fig. 6】
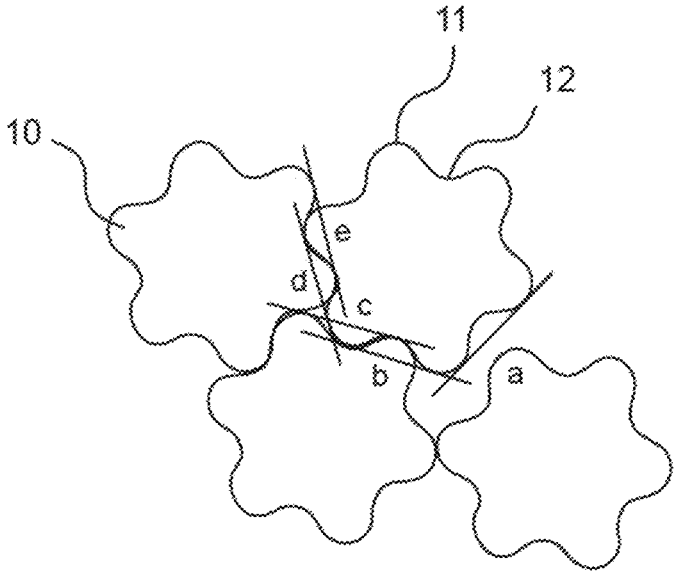

【Fig. 7】
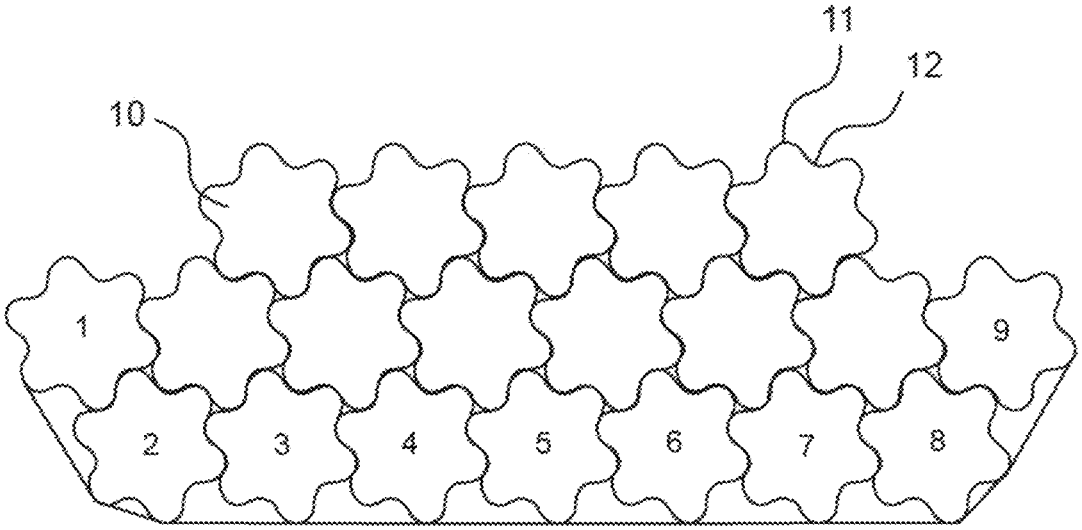

【Fig. 8】
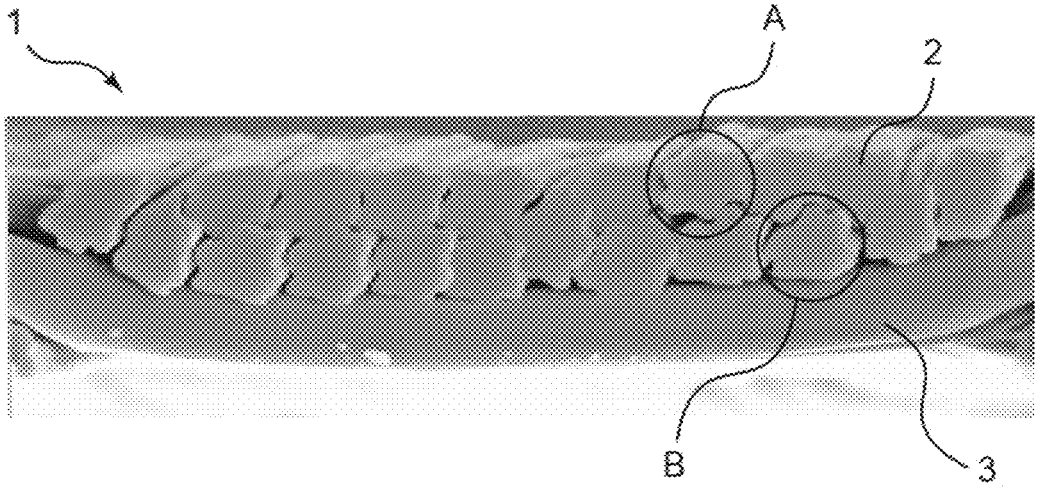

【Fig. 9】
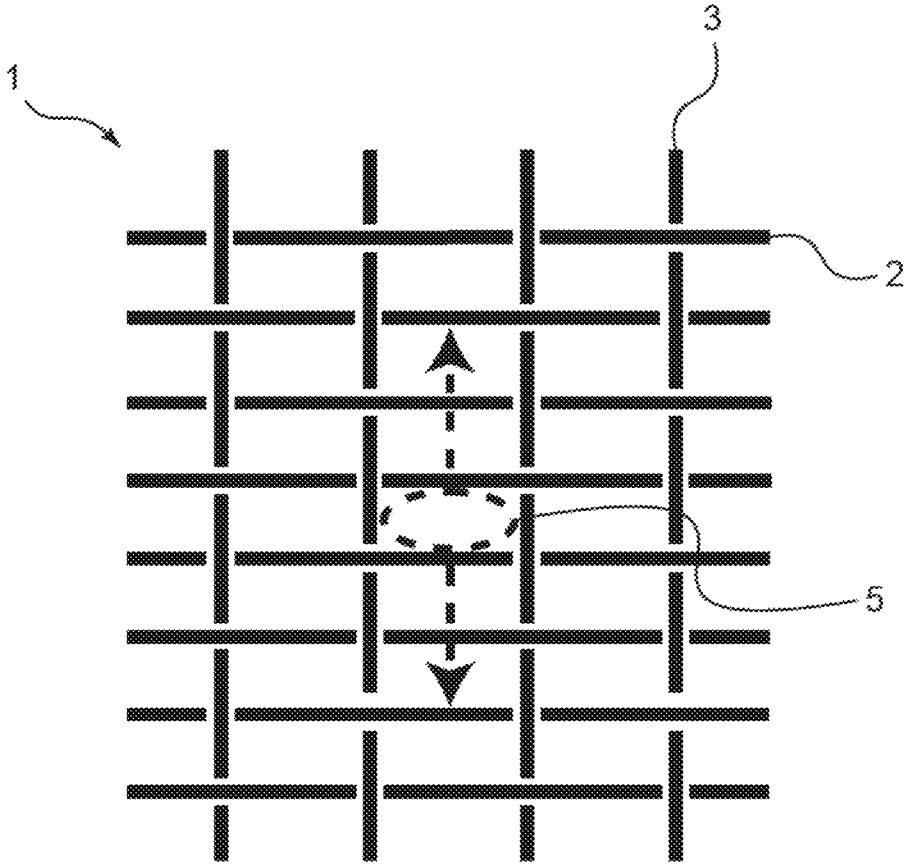

【Fig. 10】
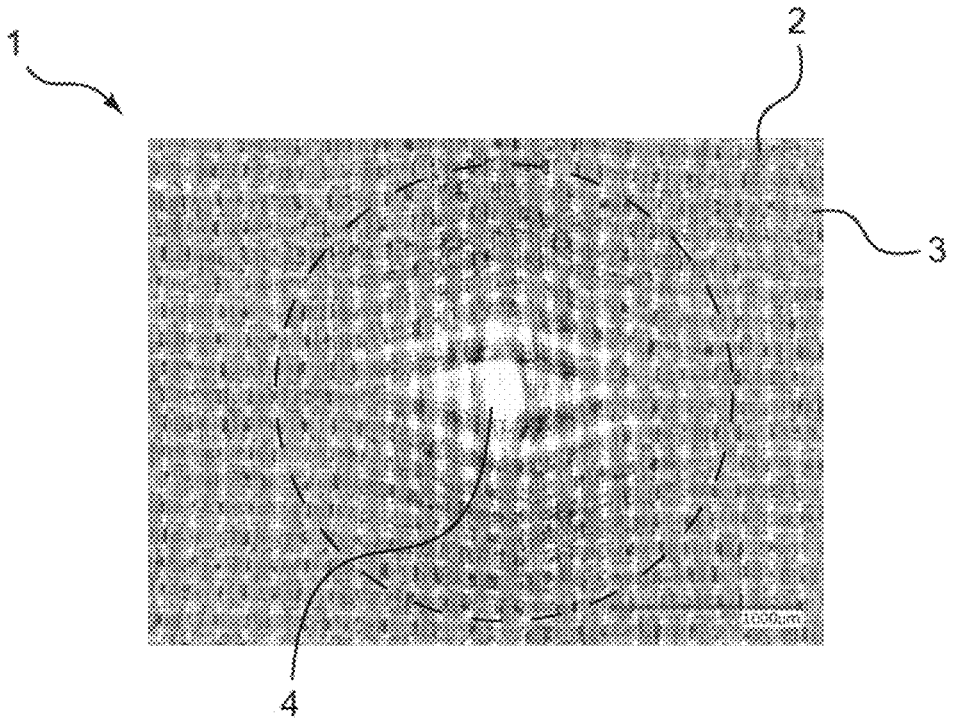

[Fig. 11]
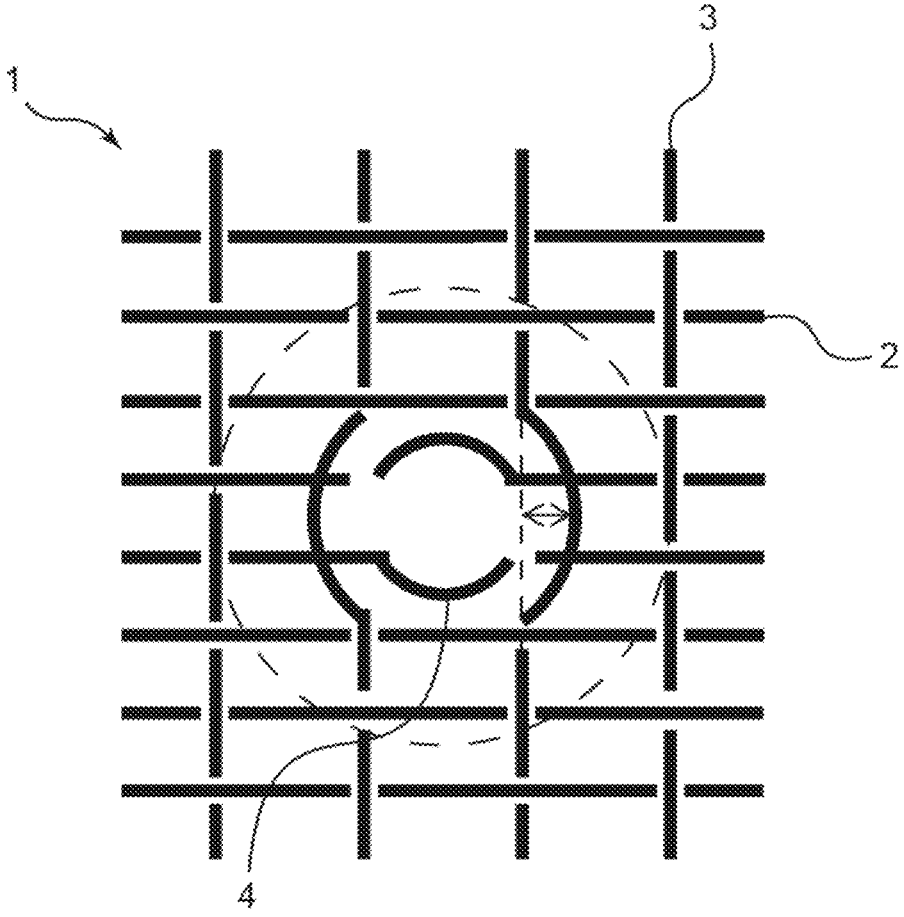

【Fig. 12】
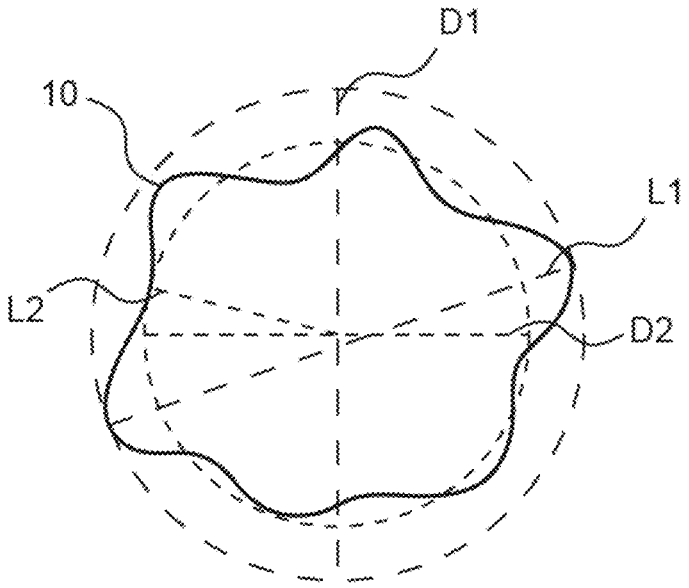

【Fig. 13】
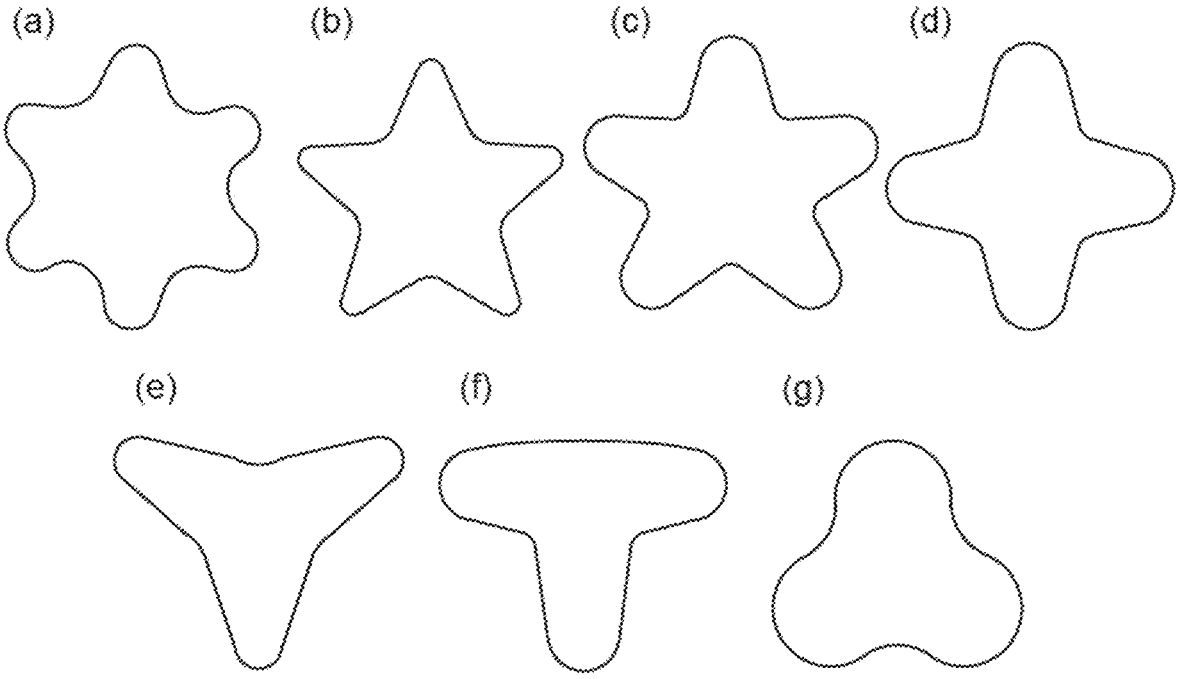

【Fig. 14】
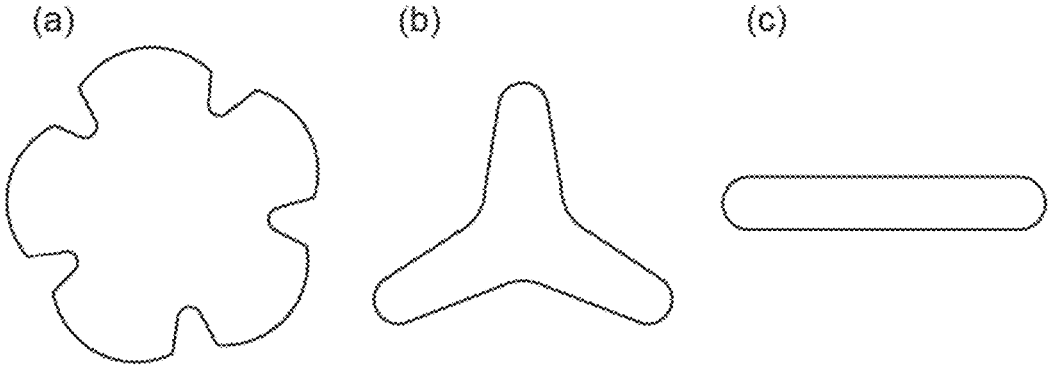

【Fig. 15】
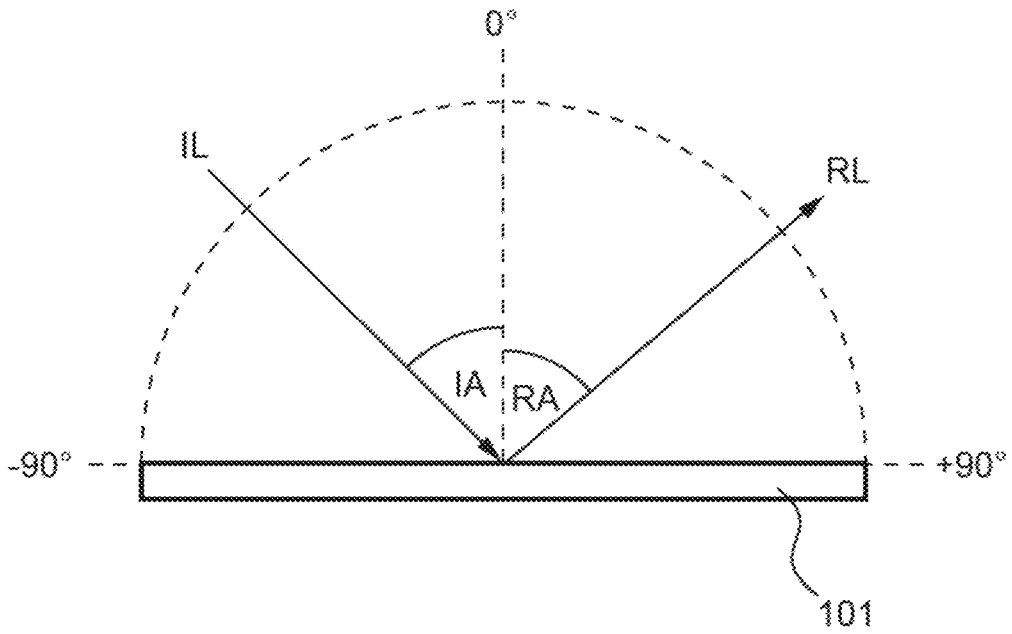

【Fig. 16】
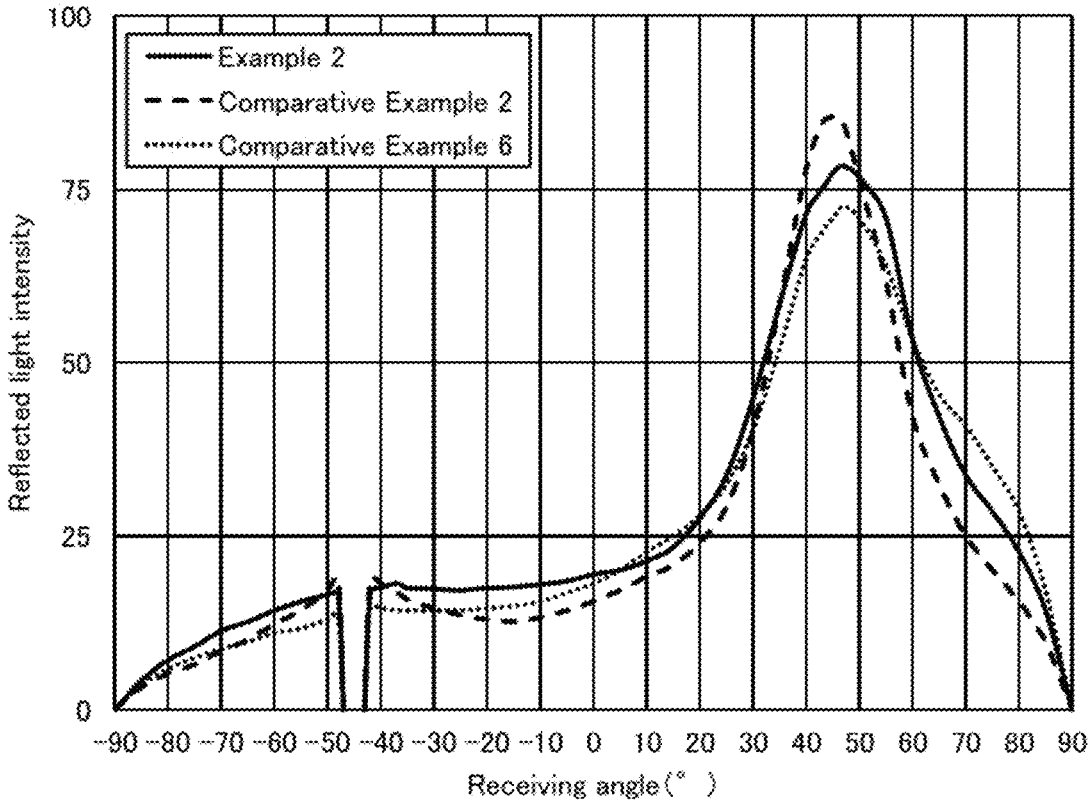

WOVEN FABRIC

FIELD OF THE INVENTION

The present invention relates to a down-proof woven fabric that is suitable for outdoor wear, sportswear, ticking, or the like and is highly effective to prevent leakage of down from a seam.

DESCRIPTION OF RELATED ART

Leakage of down often occurs from a seam of a product. The down leakage prevention performance is generally determined by air permeability of a cloth. A synthetic fiber multifilament woven fabric is prepared so as to have an air permeability of 1.5 $cm^3/cm^2 \cdot s$ or less, and further 1.0 $cm^3/cm^2 \cdot s$ or less. For example, a woven fabric having a low air permeability is produced by generally using a multifilament having a round cross section and subjecting the multifilament with an increased cover factor to calendering. However, the increase of the cover factor increases the basis weight, failing to achieve light weight.

When the cover factor is reduced for the purpose of achieving lighter weight, single yarns are mutually moved due to rubbing of washing, so that the low air permeability cannot be kept. Thus, leakage of down easily occurs. Therefore, in order to prevent leakage of down or achieve light weight, a method of producing a woven fabric having a structure of mutually engaging single yarns (see, for example, WO 2014/021013 and JP-A-2004-052191) and a method of using a fused multifilament so as not to move single yarns in the woven fabric (see, for example, JP-A-7-70848) are devised.

SUMMARY OF THE INVENTION

Problems to be Solved by the Invention

In the woven fabrics as disclosed in WO 2014/021013 and JP-A-2004-052191, however, the single yarn is flat, so that the strength thereof is low, and calendering further flattens the single yarn. Therefore, the flattened single yarn is easily cut with a sewing machine needle and the effect of preventing leakage of down from a seam is insufficient.

Further, since the woven fabric as disclosed in JP-A-7-70848 uses a fused multifilament, the texture of the woven fabric is hard, which is not suitable for clothing.

A stretchable yarn is considered to be used in order to prevent leakage of down from a seam. Although a woven fabric using the stretchable yarn is strongly tightened with machine sewing yarns and leakage of down is less likely to occur, a covered yarn of polyurethane yarn has some drawbacks such as poor durability due to ultraviolet degradation, heavy basis weight, high cost, and lack of versatility. In addition, polybutylene terephthalate (PBT) and polytrimethylene terephthalate (PTT) tend to lack light weight and flexibility, and are not commonly used for clothing. It is, therefore, required to improve these problems by using nylon yarns and polyester yarns, which are commonly used for clothing.

The present invention has been achieved under such circumstances, and its object is to provide a woven fabric which is highly effective to prevent leakage of down from a seam of a product, even with a woven fabric having a low cover factor.

Solutions to the Problems

As the result of intensive studies, the present inventors have discovered that preventing leakage of down can be enhanced by strengthening a restoring force from distortion (i.e., strongly tightening even with a thin sewing machine yarn) with a highly resistant structure, even though a single yarn is once pushed away by a sewing machine needle while the sewing machine needle passes through, and the present invention has been perfected thereby.

In order to solve the aforementioned task, the present invention has the following constitution.

(1) A woven fabric containing a single yarn having a convex portion and a concave portion in a cross section, in which an air permeability is 0.1 $cm^3/cm^2 \cdot s$ or more and 2.0 $cm^3/cm^2 \cdot s$ or less; a total fineness is 5 dtex or more and 80 dtex or less; a total cover factor of a warp and a weft is 1500 or more and 2200 or less; a cover factor of the weft is 45% or more and 56% or less, of 100% of the total cover factor of the warp and the weft; a hole is formed in the woven fabric with a sewing machine needle having a cross-sectional diameter (thickness of a main body of the sewing machine needle) of 1.00 mm, and in an area having a radius of 1.5 mm about the hole, a total number of warps and wefts that are displaced by 0.08 mm or more with the sewing machine needle is 3 or less at 15 minutes after the sewing machine needle is pulled out from the woven fabric; and the following characteristics (i) to (v) are provided:

(i) a fitting ratio of single yarns is 10% or more and 80% or less (ii) a laminating rate of the single yarn is 1.22 or more and 3.0 or less (iii) a number of convex portions of the single yarn is 2 or more and 12 or less (iv) the single yarn has a modification degree of 1.2 or more and 3.0 or less (v) a concave portion of the single yarn has a depth of 0.6 μm or more and 8 μm or less $$CF = CF_T + CF_W$$

where CF represents the total cover factor of the warp and the weft; $CF_T$ represents a cover factor of the warp; and $CF_W$ represents the cover factor of the weft.

(2) The woven fabric described in the above (1), in which a pull-out resistance of the weft is 450 mN or more and 2000 mN or less.

(3) The woven fabric described in the above (1) or (2) being subjected to calendering.

(4) The woven fabric described in any of the above (1) to (3), in which the single yarn contains 0.02% or more of titanium oxide.

A down product having the woven fabric as described in any of the above (1) to (4), in which the woven fabric is sewn with a machine sewing yarn made of a synthetic fiber having a total fineness of 100 dtex or more and 350 dtex or less.

Effect of the Invention

The woven fabric of the present invention is a woven fabric containing a single yarn having a convex portion and a concave portion in a cross section, in which an air permeability is 0.1 $cm^3/cm^2 \cdot s$ or more and 2.0 $cm^3/cm^2 \cdot s$ or less; a total fineness is 5 dtex or more and 80 dtex or less; a total cover factor of a warp and a weft is 1500 or more and 2200 or less; a ratio of a weft cover factor of the total cover factor of the warp and the weft is 45% or more and 56% or less; a hole is formed in the woven fabric with a sewing machine needle having a cross-sectional diameter (thickness of a main body of the sewing machine needle) of 1.00 mm, and in an area having a radius of 1.5 mm about the hole, a total number of warps and wefts that are displaced by 0.08 mm or more with the sewing machine needle is 3 or less at 15 minutes after the sewing machine needle is pulled out from the woven fabric; and the following characteristics (i) to (v) are provided:

(i) a fitting ratio of single yarns is 10% or more and 80% or less (ii) a laminating rate of the single yarn is 1.22 or more and 3.0 or less (iii) a number of convex portions of the single yarn is 2 or more and 12 or less (iv) the single yarn has a modification degree of 1.2 or more and 3.0 or less (v) a concave portion of the single yarn has a depth of 0.6 μm or more and 8 μm or less $$CF=CF_T+CF_W$$

where CF represents the total cover factor of the warp and the weft; $CF_T$ represents a cover factor of the warp; and $CF_W$ represents the cover factor of the weft.

When the woven fabric has the above constitution, the woven fabric can be highly effective to prevent leakage of down from a seam, even when the woven fabric has a low cover factor. Such woven fabric is suitable for sportswear, casual wear, and ticking.

BRIEF DESCRIPTION OF THE DRAWINGS

FIG. 1 shows a photograph of a cross section of a group of single yarns constituting a woven fabric according to an embodiment of the present invention;

FIG. 2 shows a photograph of a cross section of a single yarn constituting a woven fabric according to an embodiment of the present invention;

FIG. 3 shows a schematic view of a cross section of a single yarn having six convex portions according to an embodiment of the present invention;

FIG. 4 shows a schematic view of a cross section of a single yarn having four convex portions according to an embodiment of the present invention;

FIG. 5 shows a schematic view of a method of calculating a fitting ratio of the single yarns according to a woven fabric of the present invention;

FIG. 6 shows a schematic view of a fitting state of single yarns according to a woven fabric of the present invention;

FIG. 7 shows a schematic view of a method of calculating a laminating rate of single yarns according to a woven fabric of the present invention;

FIG. 8 shows a photograph of cross sections of warps and a weft of a woven fabric according to an embodiment of the present invention;

FIG. 9 shows a schematic view of a method of measuring a restoring force from a needle hole according to a woven fabric of the present invention;

FIG. 10 shows a photograph of a state where a hole is formed in a woven fabric of the present invention with a sewing machine needle;

FIG. 11 shows a schematic view of a state where a hole is formed in a woven fabric of the present invention with a sewing machine needle;

FIG. 12 shows a schematic view of a method of calculating a modification degree of a single yarn according to a woven fabric of the present invention;

FIG. 13 shows examples of cross sections of preferred single yarns according to a woven fabric of the present invention;

FIG. 14 shows examples of cross sections of unpreferred single yarns according to a woven fabric of the present invention;

FIG. 15 shows a schematic view of a method of measuring optical characteristics of a woven fabric of the present invention; and FIG. 16 shows a graph of measurement results of optical characteristics of a woven fabric of the present invention.

DETAILED DESCRIPTION OF THE INVENTION

Hereinafter, the woven fabric of present invention is described in more detail by drawings, but the present invention is by no means limited to the illustrated examples. The present invention can be suitably modified in the range adaptable to the spirit described above and below, and any of the modifications are included in the technical scope of the present invention.

The woven fabric of the present invention contains a single yarn having a convex portion and a concave portion in a cross section. The single yarn is preferably in the form of a synthetic fiber multifilament. Details of the single yarn will be described later.

(1) Air Permeability

The air permeability of the woven fabric is determined in accordance with JIS L 1096:2010 8.26.1 A method (Frazier method). The woven fabric may have an air permeability of 0.1 $cm^3/cm^2 \cdot s$ or more and 2.0 $cm^3/cm^2 \cdot s$ or less. The lower limit of the air permeability of the woven fabric may preferably be 0.15, 0.2, 0.25, 0.3, 0.35 or 0.4 $cm^3/cm^2 \cdot s$. When the lower limit of the air permeability is set as described above, the texture of the woven fabric becomes soft, so that the ease of sewing with a sewing machine can be improved. Further, a pressure generated when a product is folded allows air inside the product to escape to the outside, which can prevent leakage of down from a seam. The upper limit of the air permeability of the woven fabric may preferably be 1.0, 0.9, 0.8, 0.7 or 0.6 $cm^3/cm^2 \cdot s$. When the upper limit of the air permeability is set as described above, down-proofness of the woven fabric can be enhanced.

(2) Total Fineness

The woven fabric of the present invention may have a total fineness of 5 dtex or more and 80 dtex or less. The total fineness as described above can provide a woven fabric having a light weight and sufficient strength. The lower limit of the total fineness of the woven fabric may preferably be 8, 11, 13, 15 or 20 dtex. When the lower limit of the total fineness is set as described above, the strength of the woven fabric such as tear strength can be enhanced. The upper limit of the total fineness of the woven fabric may preferably be 70, 60, 50, 40 or 30 dtex. When the upper limit of the total fineness is set as described above, the woven fabric can be lighter in weight.

(3) Cover Factor

A total cover factor of a warp and a weft may be 1500 or more and 2200 or less. The total cover factor of the warp and the weft as described above can satisfy both down-proofness and soft texture of the woven fabric.

$$CF=CF_T+CF_W$$

where CF represents the total cover factor of the warp and the weft; $CF_T$ represents a cover factor of the warp; and $CF_W$ represents a cover factor of the weft.

The cover factors of the warp and the weft can be calculated by the following equation.

$$CF=(\text{total fineness (dtex)})^{1/2}\times\text{density (yarns/inch)}$$

The lower limit of the total cover factor of the warp and the weft may preferably be 1510, 1520, 1530, 1540 or 1550.

The upper limit of the total cover factor of the warp and the weft may preferably be 2150, 2125, 2100, 2050 or 2000. When the lower limit and the upper limit of the total cover factor of the warp and the weft are set as described above, a laminating rate of single yarns in the woven fabric can be sufficient, and a yarn pull-out resistance to tighten a machine sewing yarn or a restoring force from a needle hole can be enhanced, so that leakage of down can be less likely to occur. Further, light weight or soft texture can be easily obtained, which can improve sewing with a sewing machine.

(4) Weft Cover Factor of the Total Cover Factor of Warp and Weft

A ratio of a weft cover factor of the total cover factor of the warp and the weft may be 45% or more and 56% or less. When the ratio of the weft cover factor is as described above, the effect of preventing leakage of down can be enhanced. The weft cover factor ratio may be 45% or more, preferably 46% or more, more preferably 47% or more, and even more preferably 48% or more. When the lower limit of the weft cover factor ratio is set as described above, the yarn pull-out resistance and the restoring force from a needle hole can be enhanced, which can prevent leakage of down. The cover factor ratio of the weft is preferably 54% or less, more preferably 53% or less, and even more preferably 52% or less. When the upper limit of the weft cover factor ratio is set as described above, the warp and the weft easily uniformly tighten the machine sewing yarns, so that the effect of preventing leakage of down is enhanced, which is preferable.

(5) Fitting Ratio of Single Yarns

A woven fabric of the present invention has a structure in which at least part of the convex portions of the single yarns of the warp and/or the weft is present in the concave portions of the adjacent single yarns. In the cross section of either the warp or the weft, part of the convex portions of the adjacent single yarns is present in the concave portions of the single yarns, and its ratio is in a range of 10% or more and 80% or less, relative to the total number of convex portions of the single yarns.

The number of convex portions of the single yarn is determined as follows: As shown in FIG. 3, a tangent line is drawn between a convex portion 11 of the single yarn 10 and an adjacent convex portion 11, the tangent lines on the convex portions 11 are intersected with the adjacent tangent lines, and the number of intersection points of the tangent lines is determined as the number of the convex portions 11. When a length L of a perpendicular from a tangent line between a convex portion 11 and an adjacent convex portion 11 to the deepest point of a recess is 0.6 μm or more, the recess is determined as a concave portion 12. When the length L of the perpendicular from the tangent line to the deepest point of the recess is less than 0.6 μm, the recess is regarded as flat. The example of the shape of the single yarn 10 shown in FIG. 3 includes six convex portions 11 and six concave portions 12. In the example of the shape of the single yarn 10 shown in FIG. 4, there are four intersection points of the tangent line that passes over a recess having a depth of 0.6 μm or more from the adjacent convex portion 11 with the similar tangent line, and the number of the convex portions 11 is four. In FIG. 4, since a recess between a portion with a notation "a" and a portion with a notation "b", and a recess between a portion with the notation "b" and a portion with a notation "c" do not have a depth of 0.6 μm or more, these recesses are regarded as flat, so that the number of the convex portions 11 is four, and the number of concave portions 12 is four. The single yarn 10 has a shape in which the convex portions 11 and the concave portions 12 are repeated, and the number of convex portions 11 is equal to the number of concave portions 12.

The ratio (fitting ratio of the single yarns) in which at least part of convex portions 11 of a single yarn 10 is present in concave portions 12 of an adjacent single yarn 10 refers to a ratio of the number of the convex portions 11 in which all or part of the convex portions 11 of the single yarn 10 is/are present in the concave portions 12 of the adjacent single yarn 10. In the photograph of the cross section of the warp 2 or the weft 3, a tangent line is drawn on the convex portions 11 on both sides of the concave portion 12 of the single yarn 10, all or part of the convex portion 11 of the adjacent single yarn 10 is/are present in the line (on the bottom side of the concave portion 12). In such a case, the ratio is a value obtained when the number C of the convex portions 11 is divided by the total number D of the convex portions 12, that is, the ratio is calculated by C/D×100(%). FIG. 6 is a view showing a fitting state of the single yarn 10. In FIG. 6, the convex portion 11 with a notation "a" is not present in the concave portion 12. Namely, the convex portion 11 with the notation "a" is not fitted in the concave portion 12. A part or all of the convex portions 11 with notations "b" to "e" are present in the concave portions 12. Namely, the convex portions 11 with notations "b" to "e" are fitted in the concave portions 12. When the fitting ratio of the single yarns is calculated, the number of samples is preferably 3 or more. The total number D of convex portions represents a sum of the number of the convex portions 11 of the single yarns 10. The woven fabric 1 shown in FIG. 5 includes 20 single yarns 10 each having a six-leaf cross section with six convex portions 11. The number C of convex portions 11 at least part of which is present in the concave portion 12 is 82, and the total number D of convex portions is 120 (20 single yarns×6 convex portions), so that the fitting ratio of the single yarns is 68.3% (82/120×100).

In the state where a convex portion 11 of a single yarn 10 is present in a concave portion 12 of an adjacent single yarn 10, at least part of the convex portion 11 is preferably in contact with the concave portion 12. However, a slight movement of the single yarn 10 brings the single yarns into contact with one another at the concave portions 12 and the convex portions 11, and a restraining force works thereon. Accordingly, a state where the convex portion 11 and the concave portion 12 are separated may be contained. Mere contact of deformed single yarns such as round cross section yarns fails to give the woven fabric 1 having a high restoring force from distortion regardless of its light weight.

The fitting ratio of the single yarns may be 10% or more, preferably 12% or more, more preferably 13% or more, and even more preferably 15% or more. When the lower limit of the fitting ratio of the single yarns is set as described above, it is possible to prevent the single yarn 10 from being significantly moved by entering the sewing machine needle into the woven fabric 1, which can enhance the restoring force from distortion. Further, the fitting ratio of the single yarns may be 80% or less, preferably 75% or less, more preferably 70% or less, and even more preferably 65% or less. The upper limit of the fitting ratio of the single yarns is approximately 80% because there is always present a convex portion 11 of the single yarn 10 that exists outside of the cross section of the warp 2 or the weft 3 and that cannot come in contact with the adjacent single yarn 10. When the upper limit of the fitting ratio of the single yarns is set as described above, the texture of the woven fabric 1 becomes soft and the woven fabric 1 can be improved to sew with a sewing machine.

(6) Laminating Rate of Single Yarn

In the cross section of at least one of the warp 2 and the weft 3, a restraining force between the single yarns and a contact length of a group of single yarns that are contact with the machine sewing yarn are required to tighten the machine sewing yarn. The length of the group of single yarns can be represented by a single yarn fineness (diameter of single yarn) and a laminating rate of the single yarn. The laminating rate of the single yarn indicates to what extent a single yarn is overlapped with the other single yarn. The laminating rate of the single yarn 10 may be 1.22 or more and 3.0 or less.

The laminating rate of the single yarn 10, at a cross section of the warp 2 and the weft 3 of the woven fabric 1, is a value obtained by dividing the number F of the single yarns that are not in contact with the shortest line of those connecting the bottom portion of the single yarn 10 on an opposite surface to a calendered surface (not directly coming in contact with a calender) with the bottom portion of the adjacent single yarn 10, including the single yarns 10 at both ends, by the number E of the single yarns that are in contact with the shortest line, and can be calculated by F/E. In the woven fabric 1 shown in FIG. 7, the upper side of the plane of the paper is the calendared surface while the lower side of the plane of the paper is the surface which does not directly come in contact with the calender. The number E of the single yarns that are on the surface not directly coming in contact with the calender and are in contact with the shortest line connecting the single yarns 10 at both ends, is 9, and the number F of the single yarns that are not in contact with the shortest line is 11. Therefore, the laminating rate of the single yarn 10 is 1.22 (11 yarns/9 yarns).

Even though both surfaces or one surface of the woven fabric is/are subjected to calendering, a group of single yarns that do not directly contact with the calender are present because those single yarns are located under the warp 2 or the weft 3. The number of these single yarns 10 is determined as the number E of single yarns. When a single yarn 10 is present between adjacent single yarns and is spaced 1 μm or more apart from the line connecting between the adjacent single yarns, the single yarn 10 is considered not to be in contact with the line. In the woven fabric 1 shown in FIG. 8, the calender directly comes in contact with the warp 2 on the upper side of the plane of the paper while it indirectly comes in contact with the warp 2 on the lower side of the plane of the paper via the weft 3. The degree of deformation of the single yarn 10 tends to be the strongest on a surface which directly comes in contact with the calender, the second strongest on a surface which indirectly comes in contact with the calender via the warp 2 or the weft 3, and the weakest on a single yarn 10 which is present between those two surfaces. Although the single yarn A shown in FIG. 8 is on the surface which directly comes in contact with the calender, the calender does not sufficiently come in contact with the single yarn A, so that the single yarn A maintains its original shape of a six-leaf cross section. Details of the cross section of the single yarn A will be shown in FIG. 3. The single yarn B in FIG. 8 has the surface which the calender indirectly contacts via the weft 3 significantly deformed to be flat on the lower side of the single yarn 10. Details of the cross section of the single yarn B will be shown in FIG. 4.

The laminating rate of the single yarn 10 increases and decreases depending on the density even though yarns having the same fineness are used as the warp 2 and the weft 3. The more the density increases, the more the laminating rate tends to increase. The laminating rate of the single yarn 10 may be 1.22 or more. When the lower limit of the laminating rate of the single yarn 10 is set as described above, the single yarns 10 can be sufficiently overlapped with one another, which allows the woven fabric 1 to enhance the resistance against entering of the sewing machine needle, so that a restoring force from a needle marked hole 4, which is a hole formed in the woven fabric 1 with the sewing machine needle, can be improved. As a result, the force of tightening the machine sewing yarn with the woven fabric 1 increases, so that when a product using the woven fabric 1 is folded, a pressure from inside the product is less likely to cause down to spout out from a seam. Further, the single yarn 10 is less likely to be cut by the sewing machine needle, and the low air permeability can be easily obtained. The laminating rate of the single yarn 10 may be 3.0 or less, preferably 2.5 or less, more preferably 2.0 or less, and even more preferably 1.5 or less. When the upper limit of the laminating rate of the single yarn 10 is set as described above, the woven fabric can keep light weight without excessively increasing the density (cover factor).

(7) Number of Convex Portions

The number of the convex portions 11 of the single yarn 10 of at least one of the warp 2 and the weft 3 of the woven fabric 1 may be 2 or more and 12 or less. When the number of the convex portions 11 of the single yarn 10 is as described above, the single yarns are sufficiently engaged with one another, so that the down-proofness can be enhanced. The number of the convex portions 11 of the single yarn 10 may be 2 or more, preferably 3 or more, and more preferably 4 or more. When the lower limit of convex portions 11 of the single yarn 10 is set as described above, the restraining force between the single yarns can be strengthened, so that spouting of down from the needle marked hole 4 which is formed in the woven fabric 1 with the sewing machine needle can be satisfactory. Further, the number of the convex portions 11 of the single yarn 10 may be 12 or less, preferably 10 or less, more preferably 8 or less, and even more preferably 6 or less. When the upper limit of the number of the convex portions 11 of the single yarn 10 is set as described above, the engaged portions between the single yarns are not reduced, interstices between the single yarns are not increased, and further the down-proofness at perforated portions and unperforated portions are not reduced, which is preferable.

(8) Modification Degree of Single Yarn

The modification degree of the single yarn 10 may be 1.2 or more and 3.0 or less. When the modification degree of the single yarn 10 is as described above, distortion in the group of single yarns can be sufficiently kept, which can enhance the down-proofness. Further, the modification degree of the single yarn 10 is preferably 1.3 or more, more preferably 1.4 or more, and even more preferably 1.5 or more. When the lower limit of the modification degree of the single yarn 10 is set as described above, the shape of the single yarn 10 can be made different from a round shape, so that accumulated distortion in the group of single yarns can be increased, which can enhance the restoring force from the needle marked hole 4 made in the woven fabric 1 with the sewing machine needle. Further, the modification degree of the single yarn 10 is preferably 2.5 or less, more preferably 2.3 or less, and even more preferably 2.0 or less. When the upper limit of the modification degree of the single yarn 10 is set as described above, it is possible to prevent the single yarn 10 from being flattened, which can prevent the single yarn 10 from being broken. Therefore, the restoring force from the needle marked hole 4 formed in the woven fabric 1 with the sewing machine needle can be improved, which can prevent leakage of down from the needle marked hole 4.

When the modification degree of the single yarn 10 exceeds 3.0, the single yarn 10 is easily broken, so that the tear strength of the woven fabric 1 is reduced, involving practical problems, which is not preferable.

The single yarn 10 of the present invention preferably has a constitution as described below.

(Material)

In the woven fabric 1 of the present invention, movement of the single yarn 10 needs to be restricted in the woven fabric, and a modified cross-section yarn (simply referred to as modified yarn in some cases) is preferably used. The material of the single yarn 10 is not particularly limited, and nylon or polyester is suitably used. Examples of the nylon include polyamide-based resin such as nylon 6, nylon 11, nylon 12, and nylon 66. Of these, nylon 6 and nylon 66 are preferable. Examples of the polyester include polyethylene terephthalate (PET) fiber, copolymerized polyethylene terephthalate fiber, and polyethylene naphthalate (PEN). Of these, PET is preferable. The single yarn 10 may also be a chemically recycled yarn or a material recycled yarn.

When the material of the single yarn 10 is nylon, the nylon has a relative viscosity (RV) of preferably 2.5 or more, more preferably 2.8 or more, and even more preferably 3.0 or more. When the lower limit of the relative viscosity of the nylon is set in the above range, the cross section of the single yarn 10 becomes sharp, which can enhance the strength of the single yarn 10. The nylon also preferably has a relative viscosity of 3.5 or less. When the upper limit of the relative viscosity of the nylon is set in the above range, the single yarn 10 can be stably spun.

When the material of the single yarn 10 is polyester, the polyester has a relative viscosity (RV) of preferably 0.6 or more, and more preferably 0.7 or more. When the lower limit of the relative viscosity of the polyester is set in the above range, the cross section of the single yarn 10 can be sharp, so that the strength of the single yarn 10 is enhanced. The polyester also has a relative viscosity of preferably 1.0 or less, and more preferably 0.9 or less. When the upper limit of the relative viscosity of the polyester is set in the above range, the single yarn 10 can be easily spun.

(Additives)

The single yarn 10 may contain a pigment such as titanium oxide, kaolin, carbon black, and the like, provided that the pigment does not impair the object of the present invention. In addition, a functionalizing agent such as antistatic agent, antioxidant, ultraviolet absorber, ultraviolet shielding agent, antimicrobial agent, or the like may be added to the single yarn 10.

(Yarn Properties)

The synthetic fiber multifilament has a breaking strength of preferably 3.0 cN/dtex or more, more preferably 3.5 cN/dtex or more, and even more preferably 4.2 cN/dtex or more, in consideration of weaving properties, tear strength of the product, and the like. When the lower limit of the breaking strength is set as described above, sufficient tear strength can be imparted to the woven fabric 1. Further, the synthetic fiber multifilament has a breaking strength of preferably 6.5 cN/dtex or less, more preferably 6.3 cN/dtex or less, and even more preferably 6.0 cN/dtex or less. When the upper limit of the breaking strength is set as described above, the orientation or crystallization of the yarn can be appropriate, thereby allowing the texture of the woven fabric 1 to be softened.

The synthetic fiber multifilament has an elongation at break of preferably 20% or more, more preferably 23% or more, even more preferably 25% or more, and particularly preferably 28% or more. When the lower limit of the elongation at break is set as described above, variations of tensions during weaving can be sufficiently absorbed, so that yarn breakage can be prevented, thereby achieving enhancement of weaving properties. Further, the synthetic fiber multifilament has an elongation at break of preferably 50% or less, more preferably 48% or less, and even more preferably 45% or less. When the upper limit of the elongation at break is set as described above, it is possible to prevent the synthetic fiber multifilament from having a weakened restoring force from significant elongation due to the tension during warping and weaving, whereby warp streaks, tight weft, and uneven weft are less likely to occur.

(Form of Yarn)

A woven fabric 1 of the present invention is composed of the synthetic fiber multifilament as described above, and the form thereof is a filament yarn or a false-twisted yarn. Although the woven fabric of filament yarns has a sufficient restoring force from a needle hole, the woven fabric of false-twisted yarns has not only a restoring force from distortion because of its woven fabric structure but also has a restoring force from a sewing machine needle hole because of the crimping property of the false-twisted yarn, which is more preferable. The form of yarn is preferably selected in consideration of appearance, texture, basis weight, calendering processability, and the like of the woven fabric 1.

The woven fabric 1 may also use a spun yarn, a Taslan textured yarn, or the like in the warp 2 or the weft 3. Further, a soft-twisted yarn of 10 t/m or more and 300 t/m or less, or an entangled multifilament yarn having a degree of entanglement of 5 tangles/m or more and 60 tangles/m or less, may be used in at least one of the warp 2 and the weft 3 without impairing low air permeability and light weight.

The false-twisted yarn can be used in the form of a draw textured yarn (DTY) obtained by drawing or false twisting a partially oriented yarn (POY) and in the form of a false-twisted yarn obtained by subjecting a spin draw yarn (SDY) to friction false twisting or pin false twisting. For the purpose of obtaining a sharp modification degree or cross section, it is possible to use a false-twisted yarn (half-textured yarn) obtained under false twisting conditions where the false twisting temperature is lowered by 10° C. or more and 20° C. or less than usual, and the number of false-twists is reduced by 10% or more and 30% or less. At this time, it is also possible to impart the crimping property to the false-twisted yarn by decreasing the false twisting rate by 10% or more and 30% or less than usual. Since the false-twisted yarn has excellent crimp retentivity, nylon 66 is preferably used as nylon, and homopolymer polyester is preferably used as polyester.

The modified yarn used in the present invention is subjected to a false twisting process to thereby have a false twisted structure in which the convex portion 11 is more easily included in the concave portion 12 of the single yarn 10 than before false twisting. The false-twisted yarn has a contraction recovery rate of preferably 10% or more, and more preferably 15% or more. When the lower limit of the contraction recovery rate of the false-twisted yarn is set as described above, sufficient contraction and expansion properties can be imparted to the woven fabric 1. The false-twisted yarn also has a contraction recovery rate of preferably 30% or less, and more preferably 28% or less. When the upper limit of the contraction recovery rate of the false-twisted yarn is set as described above, the number of false-twists can be appropriate, so that the cross section of the modified yarn is allowed to have an appropriate degree of deformation, and fuzz or yarn breakage is less likely to occur in the false-twisting process, which can enhance productivity. Further, mutual adhesion of single yarns can be appropriate, which imparts soft texture to the woven fabric 1.

A method of measuring the contraction recovery rate of a crimped yarn conforms to JIS L 1013:2010 8.12. The contraction recovery rate of the crimped yarn is preferably 10% or more, more preferably 12% or more, and even more preferably 15% or more. When the lower limit of the contraction recovery rate is set as described above, the woven fabric 1 can be less likely to inhibit movement during wearing of a product. The contraction recovery rate thereof is also preferably 35% or less, more preferably 33% or less, and even more preferably 30% or less. When the upper limit of the contraction recovery rate is set as described above, the woven fabric 1 having appropriate contraction and expansion properties while maintaining low air permeability can be obtained.

(Depth of Concave Portion)

The depth of the concave portion 12 of each single yarn 10 of at least one of the warp 2 and the weft 3 of the woven fabric 1 is preferably 0.6 μm or more, more preferably 0.7 μm or more, and even more preferably 0.8 μm or more. When the lower limit of the depth of the concave portion 12 of the single yarn 10 is set as described above, a contact area between the single yarns can be sufficiently secured, entering of the sewing machine needle into the woven fabric 1 is less likely to separate between the single yarns, which can enhance a recovery action after the sewing machine needle passes through. The depth of the concave portion 12 of each single yarn 10 is preferably 8 μm or less, more preferably 6 μm or less, and even more preferably 5 μm or less. When the upper limit of the depth of the concave portion 12 of each of the single yarns 10 is set as described above, engagement between the single yarns is not deepened in the engaged portion, the texture is not hardened, and interstices between the single yarns at unengaged portions are increased, thereby preventing deterioration of down-proofness.

When the number of the convex portions 11 and the depth of the concave portion 12 are within the above range, more single yarns are mutually engaged, which inhibits movement between the single yarns, so that entering of the sewing machine needle causes significant distortion, which acts on the restoring force from the distortion to become larger, which is preferable.

(Single Yarn Fineness)

The woven fabric 1 has a strong restoring force from distortion or soft texture, so that it has a single yarn fineness of preferably 0.8 dtex or more, more preferably 1.0 dtex or more, and even more preferably 1.2 dtex or more. When the lower limit of the single yarn fineness is set as described above, snagging or decrease of slippage resistance can be prevented. The woven fabric 1 also has a single yarn fineness of preferably 3.0 dtex or less, more preferably 2.5 dtex or less, and even more preferably 2.0 dtex or less. When the upper limit of the single yarn fineness is set as described above, anti-snagging property or soft texture can be obtained.

(Number of Single Yarns)

The number of single yarns is preferably 8 or more, more preferably 10 or more, and even more preferably 12 or more. When the lower limit of the number of single yarns is set as described above, the woven fabric 1 has a satisfactory cover factor and a sufficient laminating rate of the single yarn 10, so that the force of tightening the machine sewing yarn can be increased. Further, yarn breakage by the sewing machine needle is less likely to occur. The number of single yarns is also preferably 50 or less, more preferably 48 or less, and even more preferably 45 or less. When the upper limit of the number of single yarns is set as described above, reduction of the single yarn fineness prevents the shape of the single yarn from becoming closer to a round cross section, which can prevent the woven fabric 1 from generating interstices due to rubbing or prevent moving of the single yarn 10 by the sewing machine needle. The woven fabric 1 preferably has a single yarn fineness of 1.0 dtex or more and 3.0 dtex or less, and the number of single yarns is preferably set in this range.

The woven fabric 1 of the present invention preferably has a constitution as described below.

(Restoring Force from Needle Hole)

The restoring force from the needle marked hole 4 by a sewing machine significantly affects the prevention of leakage of down especially in a low cover factor area. A sewing machine needle is inserted into either the warp 2 or the weft 3 of the woven fabric 1, having a lower cover factor to weaken the restoring force, to form a needle marked hole 4. In an area having a radius of 1.5 mm about the needle marked hole 4, the total number of the warps 2 and the wefts 3 that are displaced by 0.08 mm or more with the sewing machine needle was preferably 3 or less at 15 minutes after the sewing machine needle is pulled out from the woven fabric 1, and more preferably 2 or less at 10 minutes thereafter, and 0 within 5 minutes after the sewing machine needle is pulled out from the woven fabric 1. The warp 2 and the weft 3 that are displaced by 0.08 mm or more indicates a state where the warp 2 and the warp 3 are curved by inserting the sewing machine needle into the woven fabric 1, and a distance between a curved portion farthest from the positions of the warp 2 and the weft 3 before the sewing machine needle is inserted and the positions of warp 2 and the weft 3 before the sewing machine needle is inserted is 0.08 mm or more. As shown in FIG. 11, the positions of the warp 2 and the weft 3 before the sewing machine needle is inserted can be determined by connecting one end of the curved portion of the warp 2 and the weft 3 with the other end thereof, after the sewing machine needle is inserted in the woven fabric 1. When the restoring force from a needle hole is set as described above, a force in which the warp 2 and the weft 3 tighten the machine sewing yarn can be sufficient, and when a seam is scratched or rubbed, an interstice is less likely to generate around the seam. Further, even under the most severe condition, that is, even when an abrupt pressure change is repeated at the time of folding a woven fabric product, down is less likely to spout out together with air from a seam.

The restoring force from a needle hole can be measured by the following method. A sewing machine is manually operated using a sewing machine needle having a cross-sectional diameter (thickness of the main body of the sewing machine needle) of 1.00 mm in an environment of 20° C. and 65% RH, to form five needle marked holes 4 in the woven fabric 1 at an interval of 2 cm in either the warp 2 or the weft 3, whichever has a lower cover factor. Then, the needle marked holes 4 are photographed 15 minutes after the holes are formed. In the area having a radius of 1.5 mm about the needle marked hole 4, the total number of the warps 2 and wefts 3 that are displaced by 0.08 mm or more with the sewing machine needle is counted. The total number of the warps 2 and wefts 3 that are displaced about all the five needle marked holes 4 is counted, and an average value is then calculated. A sewing machine manufactured by Janome Sewing Machine Co., Ltd. and a sewing machine needle with DB×1, a needle size of 14/90, and a coating style of PD, manufactured by Organ Needle Co., Ltd. can be used to form holes with the sewing machine needle. To photograph the cloth having the holes formed, a VHX-5000 manufactured by Keyence Corporation can be used at 100 magnifications.

A method of measuring the restoring force from the needle hole will be described herein below in detail. The sewing machine needle has a round tip, and the middle portion in the lengthwise direction thereof is flat in shape. The woven fabric 1 is arranged on the sewing machine so that either the warp 2 or the weft 3 of the woven fabric 1, whichever has a lower cover factor, is positioned along the advancing direction of the fabric to be sewn by the sewing machine. While the woven fabric 1 is fed forward or backward, the sewing machine needle is inserted into the woven fabric 1 so that the long-axis direction of the flat-shaped portion of the sewing machine needle is in parallel to the extending direction of either the warp 2 or the weft 3, whichever has a higher cover factor, to thereby form a needle marked hole 4. An example is shown in FIG. 9. In the woven fabric 1 in FIG. 9, the weft 3 has a lower cover factor than the warp 2. The woven fabric 1 is arranged so that the long-axis direction of the flat-shaped portion 5 of the sewing machine needle is in parallel to the extending direction of the warp 2 which is a yarn having a higher cover factor. The sewing machine is manually operated at about a constant speed for 20 seconds to form four additional needle marked holes 4 with the sewing machine needle. Sewing is advanced with the sewing machine so that the short-axis direction of the flat-shaped portion 5 of the sewing machine needle is in parallel to the weft 3 which is a yarn having a lower cover factor. At this time, a subsequent needle marked hole 4 is formed at a position which is not affected by the needle marked hole previously formed, and an interval of the needle marked holes 4 is preferably 2 cm.

FIGS. 10 and 11 show the warp 2 and the weft 3 that are displaced by the sewing machine needle. The woven fabric 1 with few displaced yarns immediately after a hole is formed therein strongly tightens the machine sewing yarn and is less likely to cause leakage of down, which is preferable. The state where there is no displaced yarn immediately after the sewing machine needle is pulled out is optimal. A thin woven fabric uses a thin machine sewing yarn, and the woven fabric 1 having a strong restoring force from a needle hole advantageously works to prevent leakage of down.

(Yarn Pull-Out Resistance)

The yarn pull-out resistance is determined according to JIS L 1062:2006 7.2 B method (JIS L 1096:2010 8.23.2 A method). The yarn pull-out resistance refers to difficulty of moving the warp 2 or the weft 3 in the woven fabric, and either the warp 2 or the weft 3, whichever has a lower cover factor, has a yarn pull-out resistance of preferably 450 mN or more, and more preferably 500 mN or more. When the lower limit of the yarn pull-out resistance is set as described above, it is possible to prevent the warp 2 and the weft 3 from being slipped to spread when the sewing machine needle is entered into the woven fabric 1, distortion is increased in the woven fabric to increase a force of restricting the machine sewing yarn, fill the interstices in the warp 2 and the weft 3, so that leakage of down is less likely to occur. The yarn pull-out resistance is preferably 2000 mN or less, more preferably 1600 mN or less, and even more preferably 1400 mN or less. When the upper limit of the yarn pull-out resistance is set as described above, the sewing machine needle can be smoothly entered and retracted into/from the woven fabric 1, so that breaking of the sewing machine needle can be prevented, and a lift near a seam is less likely to occur, to thereby enhance product quality.

To achieve such a woven fabric structure, it is necessary that part of the convex portion 11 of the single yarn 10 is present in the concave portion 12 of the single yarn 10, and the laminating rate of the single yarn 10 is within the above-mentioned range.

(Weaving Pattern)

The weaving pattern is preferably plain weave and ripstop weave in view of light weight, and may be twill weave, satin weave, or other dobby weaves. The woven fabric 1 may usually be produced with a water jet loom after sizing, or may be produced with an air jet loom, a rapier loom, or the like depending on the kind of yarn.

(Processing: Scouring, Dyeing, Finishing)

The processing on the woven fabric 1 formed from synthetic fiber multifilament may be performed on general processes and conditions for down-proof woven fabric. The woven fabric 1 is subjected to desizing and scouring in a spread state, dried, subjected to middle-setting, and then dyed (with a jigger, beam, or jet dyeing machine). Subsequently, the dyed woven fabric is subjected to water-repellent finishing and calendering, inspected, taken up, and then packed.

In the scouring of the woven fabric 1 including single yarns 10 each having convex and concave portions, a sizing agent for weaving such as polyvinyl alcohol or starch remains in the concave portion 12, which may degrade the dyeing quality, and it is therefore preferable that the remaining sizing agent is sufficiently removed. General formulation and conditions in accordance with the material may be used for dyeing.

The woven fabric 1 is subjected to calendering on one or both surfaces thereof using a heating roll of metal and the other roll of resin or paper. In the case of nylon 6, calendering is performed at a roll temperature of 100° C. or higher and 190° C. or less, a pressurizing force of 1.0 MPa or more and 5.0 MPa or less, and a rate of 5 m/min or more and 30 m/min or less once or a plurality of times. In the case of nylon 66 and polyester, calendering is preferably performed at a temperature of 210° C. or less. In the present invention, there are few interstices between the single yarns in the woven fabric, so that calendering a few times may easily impart a low air permeability to the woven fabric.

(Properties of Woven Fabric)

Leakage of down can be evaluated in accordance with IDFL (International Down and Feather Laboratory and Institute) test method 20-1 (2008 October edition, down 40%/feather 60% filling used). The number of leakages of down from a seam is obtained by subtracting the number of leakage (from portions other than seam) when a seal is affixed to the seam from the number of leakages when a seal is not affixed to the seam. The measurement is performed twice, and an average value is calculated. The following two kinds of machine sewing yarns are used (sewing machine needle #14, stitching 6 stitches/cm): (i) in the case where the woven fabric 1 is a non-crimped woven fabric, nominal #60 yarn (polyester filament 56T three-folded twist, total fineness of 168 dtex) manufactured by Tsuyama Gunze, (ii) in the case where the woven fabric 1 is a crimped woven fabric, nylon woolly yarn, product number 211, manufactured by Tsuyama Gunze (122 dtex two-folded twist, total fineness of 224 dtex). The number of leakages of downs at a portion other than the seam is evaluated on a 5-point scale according to TABLE 1 shown below, and rating 3 or higher is considered as acceptable. In the case of 3 or higher rating, leakage of down is less likely to occur in use, which is preferable.

TABLE 1

| Rating | Number of leakages | |
|---|---|---|
| | Down | Feather |
| 5 | ≤5 | ≤1 |
| 4 | 6-10 | 2 |
| 3 | 11-20 | 3-4 |
| 2 | 21-30 | 5-7 |
| 1 | ≥31 | ≥8 |

The yarn pull-out resistance is determined in accordance with JIS L 1062:2006 7.2 B method (JIS L 1096:2010 8.23.2 A method). Either the warp 2 or the weft 3, whichever has a lower cover factor, is used to determine the yarn pull-out resistance because a yarn having a weaker force of tightening the machine sewing yarn easily cause leakage of down.

The tear strength of the woven fabric 1 is determined in accordance with JIS L 1096:2010 8.17.4 D method (pendulum method). The tear strength is preferably 7 N or more, more preferably 8 N or more, and even more preferably 9 N or more. When the lower limit of the tear strength is set as described above, the product can be less likely to be torn from a seam. The tear strength is also preferably 50 N or less. When the upper limit of the tear strength is set as described above, the basis weight of the woven fabric 1 can be appropriately low.

The slippage resistance of the woven fabric 1 is determined in accordance with JIS L 1096:2010 8.23.1 D method. The slippage resistance refers to the strength against "slippage" of a seam of the woven fabric. The slippage resistance is preferably 0.2 mm or more, more preferably 0.3 mm or more, and even more preferably 0.4 mm or more, under a load of 117 N (12 kgf). When the lower limit of the slippage resistance is set as described above, the texture of the woven fabric 1 becomes soft, which allows the sewing machine needle to easily pass through. The slippage resistance is also preferably 2.5 mm or less, more preferably 2.0 mm or less, and even more preferably 1.5 mm or less. When the upper limit of the slippage resistance is set as described above, down-proofness of the woven fabric 1 can be enhanced. The load applied for the measurement of the slippage resistance may tear the woven fabric 1 because of its excessive load on a thin woven fabric of 17 T or less. In such case, the measurement is made under a load of 78 N (8 kgf).

The basis weight of the woven fabric 1 is determined in accordance with JIS L 1096:2010 8.3.2. The basis weight of the woven fabric 1 is preferably 15 g/m$^2$ or more, more preferably 18 g/m$^2$ or more, and even more preferably 20 g/m$^2$ or more. When the lower limit of the basis weight is set as described above, sufficient tear strength can be imparted to the woven fabric 1, which can prevent the woven fabric 1 from being torn from a seam. The basis weight of the woven fabric 1 is also preferably 80 g/m$^2$ or less, more preferably 60 g/m$^2$ or less, and even more preferably 40 g/m$^2$ or less. When the upper limit of the basis weight is set as described above, the woven fabric 1 can be light in weight, which is less likely to inhibit movement during wearing of a product.

The elongation rate of the woven fabric 1 is determined in accordance with JIS L 1096:2010 8.16.1 B method (constant load method for fabric). The elongation rate of a crimped woven fabric is preferably 5% or more, more preferably 6% or more, and even more preferably 7% or more, in the warp and weft directions or in the weft direction. When the lower limit of the elongation rate is set as described above, the woven fabric 1 can be easily handled. The elongation rate thereof is also preferably 15% or less, more preferably 13% or less, and even more preferably 10% or less. When the upper limit of the elongation rate is set as described above, leakage of down can be less likely to occur at the elongation of the woven fabric 1.

(Machine Sewing Yarn)

A non-fluffy yarn or fluffy yarn made of synthetic fiber is suitably used as the machine sewing yarn used when a product is made with the woven fabric 1 of the present invention, and multifilament and spun yarn of polyester and nylon are used as materials. Examples of the multifilament includes a non-crimped yarn and a crimped yarn. A machine sewing yarn of a non-crimped yarn or a spun yarn is generally used in a non-crimped filament woven fabric, while a crimped (woolly) type machine sewing yarn is generally used in a crimped woven fabric.

In the present invention, a spun-yarn type machine sewing yarn is more preferably used. The use of such a machine sewing yarn allows the effect of preventing leakage of down to be easily obtained because friction between the machine sewing yarn sewn on the woven fabric 1 and the woven fabric 1 is large to thereby prevent the machine sewing yarn from moving. The machine sewing yarn is used by twisting two or three raw yarns to increase tensile strength. The machine sewing yarn has a total fineness of preferably 100 dtex or more and 350 dtex or less (nominal #100 to 28), more preferably 150 dtex or more and 300 dtex or less (nominal #66 to 33), and even more preferably 150 dtex or more and 250 dtex or less (nominal #66 to 40). The used raw yarn has a fineness of preferably 50 dtex or more and 170 dtex or less as a multifilament and preferably No. 50 or more and No. 80 or less as a spun yarn in terms of English cotton count. When the total fineness of the machine sewing yarn is set as described above, the product can be less likely to be ripped from a seam, a tight tension is also less likely to occur, so that the appearance of the product can be enhanced. As for nominal #, a machine sewing yarn having a length of 100 m per 100 g is nominal #1, and a machine sewing yarn having a length of 200 m per 100 g is nominal #2.

Both a non-crimped and crimped machine sewing yarns have a tensile strength of preferably 640 cN or more and 1300 cN or less. A non-crimped machine sewing yarn has a tensile elongation of preferably 16% or more and 26% or less while a crimped machine sewing yarn has a tensile elongation of preferably 29% or more and 40% or less. When the tensile strength and the tensile elongation of the machine sewing yarn are within these ranges, a product which prevents tear from a seam, excellent in light weight and contraction and expansion properties, and has good appearance can be obtained.

(Appearance Quality of Woven Fabric)

The present inventors' studies have revealed that a woven fabric using fibers having a large modification degree as disclosed in WO 2014/021013, JP-A-2004-052191, and JP-A-7-70848 has a drawback of skitteriness (gloss unevenness). The skitteriness is caused by diffused reflection of light by the single yarn on the surface of the woven fabric, or so-called white blurring that is a white blurred appearance, resulting in low appearance quality. The woven fabric of the present invention can reduce such skitteriness (gloss unevenness) to give gloss of high-class feeling of metallic gloss, and can enhance appearance quality.

The appearance quality of the woven fabric 1 may be evaluated by confirming the optical characteristics of the woven fabric 1. Specifically, the appearance quality of the woven fabric 1 is evaluated by using a half width (half width at half maximum: HWHM) of a reflected light distribution that is a function of intensity and angle of the reflected light, representing a degree of scattering of the reflected light at the time of exposure of the woven fabric 1 to light.

The half width at half maximum in the reflected light distribution of the woven fabric 1 is preferably 22 degrees or less, more preferably 20 degrees or less, and even more preferably 19 degrees or less. When the upper limit of the half width at half maximum of the reflected light distribution is set to the above range, the reflected light generated when the woven fabric 1 is exposed to light is metallic gloss, which provides a woven fabric 1 with less gloss unevenness and a high appearance quality. The lower limit of the half width at half maximum of the reflected light distribution is not particularly limited, and can be, for example, 5 degrees or more, 10 degrees or more, or 15 degrees or more.

The half width at half maximum of the reflected light distribution can be determined as follows. Using an automatic variable angle photometer (GP-200, manufactured by Murakami Color Research Laboratory), as shown in FIG. 15, a sample 101 is exposed to light (incident light II) and the intensity of a reflected light RL at a receiving angle RA is measured. The receiving angle RA is in the range of −90 degrees to +90 degrees, when an angle perpendicular to the incident light IL irradiated surface of the sample 101 is set to 0 degrees. A graph of the reflected light distribution is created to show the measurement results with the receiving angle RA as the abscissa and the intensity of the reflected light RL as the ordinate. The half width at half maximum of the reflected light distribution is determined using the graph to measure the width of the receiving angle RA of the reflection light RL to become 50% of peak values.

EXAMPLES

Hereinafter, the operation and effect of the present invention is described in more detail by Examples. However, the present invention is by no means limited to the following Examples. The present invention can be suitably modified in the range adaptable to the spirit described above and below, and any of the modifications are included in the technical scope of the present invention.

As shown in FIG. 12, the modification degree of the single yarn 10 was calculated by a ratio of a diameter D1 of a circle having a line L1 representing a major axis of the single yarn 10 as a diameter to a diameter D2 of a circle having a radius L2 defined by a center point of D1 and a concave portion 12 of the single yarn 10, the concave portion 12 being the farthest from the center point of D1, or D1/D2. The number of samples was 10.

A relative viscosity RV was determined as described below. A sample was dissolved in 96.3±0.1% by mass of a concentrated sulfuric acid extra pure reagent to give a polymer concentration of 10 mg/ml. In this way, a sample solution was prepared. Next, an Ostwald viscometer giving a water dropping time of 6 to 7 seconds at a temperature of 20° C.±0.05° C. was used to measure the dropping time T1 (seconds) of 20 ml of the prepared sample solution and the dropping time T0 (seconds) of 20 ml of 96.3±0.1% by mass of the concentrated sulfuric acid extra pure reagent used for the dissolution of the sample, at 20° C.±0.05° C. The relative viscosity (RV) of the used material was then calculated by the following equation.

$$RV=T1/T0$$

Example 1

A nylon 6 POY of 35 dtex and 24 filaments in which the RV of a resin was 3.5 was false-twisted at a temperature of 160° C. and a draw ratio of 1.3 with a friction false twisting machine to give a false-twisted yarn having 27 dtex, a contraction recovery rate of 27.9%, a breaking strength of 3.6 cN/dtex, and an elongation at break of 28.2%. The shape and modification degree of the single yarn are shown in Table 2. The cross section of the single yarn was a three-leaf cross section (Y shape) shown in FIG. 13(*e*). Next, a woolly taffeta having a density as listed in Table 2 was woven, and the fabric thus woven was subjected to desizing and scouring in a spread state. After dehydration, the woven fabric was dried with a pin tenter at 160° C. for 30 seconds. The dried woven fabric was then dyed with an acid dye using a jet dyeing machine while being boiled for 40 minutes. Further, the dyed woven fabric was dipped in a non-fluorine water repellent solution, squeezed by a mangle, and cured at 150° C. for 30 seconds. Thereafter, the same surface of the cured woven fabric was subjected to calendering twice at 190° C., 1.5 MPa, and 15 m/min, to give a finished roll of woven fabric. The characteristics and the cross section of the woven fabric were shown in Table 3 and FIG. 1, respectively. The woven fabric thus obtained had a low air permeability, excellent in the restoring force from a needle hole and the yarn pull-out resistance, and excellent in preventing leakage of down from a seam when compared with the woven fabric in Comparative Example 1. Regarding the restoring force from a needle hole, the needle marked hole was not confirmed when one minute elapsed from the formation of the hole.

Comparative Example 1

The same steps of spinning (POY), false twisting, weaving, and dyeing finish as in Example 1 were performed, except that the cross section of the single yarn in Example 1 was changed to a round cross section, to thereby obtain a woven fabric. The results are shown in Table 3. The woven fabric thus obtained failed to achieve low air permeability, was weak in the restoring force from a needle hole and the yarn pull-out resistance, and was disadvantageous in preventing leakage of down from a seam or a portion other than the seam. In an area having a radius of 1.5 mm or less about the needle marked hole, the total number of warps and wefts that were displaced by 0.08 mm or more with the sewing machine needle was 8 immediately after the hole was formed, and 5 after 15 minutes.

Example 2

A nylon 6 including a resin having an RV of 3.5, in which the shape of the single yarn before calendering is a six-leaf cross section yarn (a modification degree of 1.4, a breaking strength of 5.4 cN/dtex, an elongation at break of 48%) shown in FIG. 13(*a*) was used as a warp to weave a taffeta. The woven taffeta was subjected to desizing and scouring in a spread state, and thereafter dried to set with a tenter at 160° C. for 30 seconds. Using an acid dye, the dried woven fabric was subjected to jet dyeing while being boiled for 40 minutes. After dehydration and dyeing, the dyed woven fabric was immersed into a non-fluorine water repellent solution, squeezed by a mangle, and finished at 150° C. for 30 seconds. Thereafter, the same surface of the finished woven fabric was subjected to calendering twice at a pressure roll temperature of 190° C., a pressure of 1.5 MPa, and 20 m/min, to give a woven fabric shown in Table 3. The cross section of the woven fabric was shown in FIG. 2. Regarding the restoring force from a needle hole, the needle marked hole was not confirmed when one minute elapsed from the formation of the hole. The woven fabric thus obtained was excellent in preventing leakage of down from a seam and a portion other than the seam when compared with the woven fabric in Comparative Example 2.

Comparative Example 2

The same procedures as in Example 2 were performed, except that the cross section of the single yarn in Example 2 was changed to a round cross section, to weave a gray fabric and perform dyeing finish, so that a woven fabric shown in Table 3 was obtained. The woven fabric thus obtained was inferior to Example 2 in the restoring force from a needle hole, the yarn pull-out resistance, and the prevention of leakage of down. In the area having a radius of 1.5 mm about the needle marked hole, the total number of warps and wefts that were displaced by 0.08 mm or more with the sewing machine needle was 15 immediately after the hole was formed, and 11 after 15 minutes.

Example 3

A polyester POY (titanium oxide content of 2.1%) having 50 dtex and 34 filaments was false-twisted at a temperature of 210° C., a draw ratio of 1.5 with a friction false twisting machine to give a false-twisted yarn having 34 dtex, a contraction recovery rate of 24.0%, a breaking strength of 3.2 cN/dtex, and an elongation at break of 25.1%. The shape and modification degree of the single yarn are shown in Table 2. The cross section of the single yarn was the three-leaf cross section (Y shape) shown in FIG. 13(*e*). Next, a woolly taffeta having a density as listed in Table 2 was woven, and the thus woven fabric was subjected to desizing and scouring in a spread state. After dehydration, the woven fabric was dried with a pin tenter at 160° C. for 30 seconds. The dried woven fabric was then dyed using a disperse dye with a jet dyeing machine at 130° C. for 40 minutes. Further, the dyed woven fabric was dipped in a non-fluorine water repellent solution, squeezed by a mangle, and cured at 160° C. for 30 seconds. Thereafter, the same surface of the cured woven fabric was subjected to calendering twice at 200° C., 2.0 MPa, and 20 m/min, to give a finished roll of woven fabric. The characteristics and the cross section of the woven fabric were shown in Table 3 and FIG. 1, respectively. The woven fabric thus obtained had a low air permeability, excellent in restoring force from a needle hole and yarn pull-out resistance, and excellent in preventing leakage of down. Regarding the restoring force from a needle hole, the needle marked hole was not confirmed when one minute elapsed from the formation of the hole.

Example 4

A polyester having 22 dtex (24 filaments, titanium oxide content of 0.2%, a breaking strength of 5.1 cN/dtex, a elongation at break of 38%), in which the shape of the single yarn is a six-leaf cross section yarn (a modification degree of 1.4) shown in FIG. 13(*a*), was used as a weft to weave a woven fabric in a ripstop pattern (repeating pattern of 2 in the same weave and 5 in plain weave) at the density listed in Table 2, and to perform dyeing finish as in Example 3, to thereby obtain a woven fabric. The results are shown in Table 3. Regarding the restoring force from a needle hole, the needle marked hole was not confirmed when 15 minutes elapsed from the formation of the hole.

Example 5

The same steps of weaving a gray fabric and performing dyeing finish as in Example 2 were performed, except that the number of single yarns was changed to 10 and the modification degree was changed to 1.6, to thereby obtain a woven fabric. The results are shown in Table 3.

Example 6

The same steps of weaving a gray fabric and performing dyeing finish as in Example 2 were performed, except that the number of single yarns was changed to 7, to thereby obtain a woven fabric. The results are shown in Table 3.

Example 7

The same steps of weaving a gray fabric and performing dyeing finish as in Example 2 were performed, except that the shape of the single yarn was changed to the shape shown in FIG. 13(*b*) and the modification degree was changed to 1.8, to thereby obtain a woven fabric. The results are shown in Table 3.

Example 8

The same steps of weaving a gray fabric and performing dyeing finish as in Example 2 were performed, except that the number of single yarns was changed to 15, the shape of the single yarn was changed to the shape shown in FIG. 13(*d*), and the modification degree was changed to 2.0, to thereby obtain a woven fabric. The results are shown in Table 3.

Example 9

The same steps of weaving a gray fabric and performing dyeing finish as in Example 2 were performed, except that the shape of the single yarn was changed to the shape shown in FIG. 13(*g*) and the modification degree was changed to 1.7, to thereby obtain a woven fabric. The results are shown in Table 3.

Example 10

The same steps of weaving a gray fabric and performing dyeing finish as in Example 2 were performed, except that the shape of the single yarn was changed to the shape shown in FIG. 13(*e*) and the modification degree was changed to 2.4, to thereby obtain a woven fabric. The results are shown in Table 3.

Example 11

The same steps of weaving a gray fabric and performing dyeing finish as in Example 2 were performed, except that the total fineness was changed to 56 dtex, the number of single yarns was changed to 34, and the cover factor was changed, to thereby obtain a woven fabric. The results are shown in Table 3.

Example 12

The same steps of weaving a gray fabric and performing dyeing finish as in Example 2 were performed, except that the cover factor was changed, to thereby obtain a woven fabric. The results are shown in Table 3.

Comparative Example 3

The same steps of weaving a gray fabric and performing dyeing finish as in Example 2 were performed, except that in the calendering step in Example 2, the temperature was changed to 150° C. and calendering was performed once, to thereby obtain a woven fabric. The results are shown in Table 3. The woven fabric thus obtained had a high air permeability, a low ratio of the convex portion included in the concave portion, weak in the restoring force from a needle hole and the yarn pull-out resistance, and less effective to prevent leakage of down.

Comparative Example 4

The same steps of weaving a gray fabric and performing dyeing finish as in Example 2 were performed, except that the shape of the single yarn was changed to the shape shown in FIG. 14(*a*) (modification degree 1.6), to thereby obtain a woven fabric. The results are shown in Table 3. Since the single yarn had the shape in which the convex portion did not fit into the concave portion, the woven fabric thus obtained was weak in the restoring force from a needle hole and the yarn pull-out resistance, and less effective to prevent leakage of down.

Comparative Example 5

The same steps of weaving a gray fabric and performing dyeing finish as in Example 2 were performed, except that the total fineness was changed to 11 dtex, the number of single yarns was changed to 5, the modification degree was changed to 1.6, and the cover factor was changed, to thereby obtain a woven fabric. The results are shown in Table 3. Since the laminating rate was zero (single layer arrangement structure), the woven fabric thus obtained was weak in the restoring force from a needle hole and the yarn pull-out resistance, and somewhat less effective to prevent leakage of down. In addition, the tear strength thereof was low.

Comparative Example 6

The same steps of weaving a gray fabric and performing dyeing finish as in Example 2 were performed, except that the number of single yarns was changed to 12, and the shape of the single yarn was changed to the shape shown in FIG. 14(*b*) (modification degree 3.5), to thereby obtain a woven fabric. The results are shown in Table 3. The woven fabric thus obtained satisfied the items other than the tear strength, but the tear strength thereof was somewhat low. It is deduced that the reason for this was because large modification degree in the woven fabric leads to further flattening of the single yarn.

Comparative Example 7

The same steps of weaving a gray fabric and performing dyeing finish as in Example 2 were performed, except that the cover factor was reduced, to thereby obtain a woven fabric. The results are shown in Table 3. The woven fabric thus obtained had a high air permeability, weak in the restoring force from a needle hole and the yarn pull-out resistance, not effective to prevent leakage of down, and weak in the tear strength.

Comparative Example 8

The same steps of weaving a gray fabric and performing dyeing finish as in Example 2 were performed, except that the cover factor ratio of the warp was changed (the ratio of the weft was reduced), to thereby obtain a woven fabric. The results are shown in Table 3. Although the cover factor of the warp and the weft was equal to that in Example 2, the woven fabric thus obtained was weaker in the restoring force from a needle hole and the yarn pull-out resistance, less effective to prevent leakage of down, and had lower tear strength in the weft direction than the woven fabric in Example 2.

Comparative Example 9

The same steps of weaving a gray fabric and performing dyeing finish as in Example 2 were performed, except that the number of single yarns was changed to 10, and the shape of the single yarn was changed to the flat shape shown in FIG. 14(*c*) having a modification degree of 6.9, to thereby obtain a woven fabric. The results are shown in Table 3. The woven fabric thus obtained was strong in the yarn pull-out resistance, weak in the restoring force from a needle hole, and less effective to prevent leakage of down. In addition, the tear strength thereof was low.

TABLE 2

| | Warp | | Weft | | Content of | Single | | | | Density of gray | | |
|---|---|---|---|---|---|---|---|---|---|---|---|---|
| | | Number | | Number | $TiO_2$ in | yarn | Shape of single yarn | | | fabric (yarns/inch) | | |
| | Fineness | of single | Fineness | of single | warp and | fineness | | Modification | | | | |
| | (dtex) | yarns | (dtex) | yarns | weft (%) | (dtex) | Shape | degree | FIG. | Warp | Weft | CF |
| Example 1 | 27 | 24 | 27 | 24 | 0.02 | 1.1 | Y | 2.5 | 13(e) | 157 | 155 | 1621 |
| Example 2 | 22 | 20 | 22 | 20 | 0.02 | 1.1 | Six-leaf | 1.4 | 13(a) | 160 | 160 | 1501 |
| Example 3 | 34 | 34 | 34 | 34 | 2.1 | 1.1 | Y | 2.4 | 13(e) | 142 | 140 | 1644 |
| Example 4 | 22 | 24 | 22 | 24 | 0.2 | 0.9 | Six-leaf | 1.4 | 13(a) | 163 | 160 | 1515 |
| Example 5 | 22 | 10 | 22 | 10 | 0.02 | 2.2 | Six-leaf | 1.6 | 13(a) | 160 | 160 | 1501 |
| Example 6 | 22 | 7 | 22 | 7 | 0.02 | 3.1 | Six-leaf | 1.6 | 13(a) | 160 | 160 | 1501 |
| Example 7 | 22 | 20 | 22 | 20 | 0.02 | 1.1 | Pentagon | 1.8 | 13(b) | 160 | 160 | 1501 |
| Example 8 | 22 | 15 | 22 | 15 | 0.02 | 1.5 | Cross | 2 | 13(d) | 160 | 160 | 1501 |
| Example 9 | 22 | 20 | 22 | 20 | 0.02 | 1.1 | Three-leaf | 1.7 | 13(g) | 160 | 160 | 1501 |
| Example 10 | 22 | 20 | 22 | 20 | 0.02 | 1.1 | Y | 2.4 | 13(e) | 160 | 160 | 1501 |
| Example 11 | 56 | 34 | 56 | 34 | 0.02 | 1.6 | Six-leaf | 1.4 | 13(a) | 134 | 120 | 1901 |
| Example 12 | 22 | 20 | 22 | 20 | 0.02 | 1.1 | Six-leaf | 1.4 | 13(a) | 214 | 195 | 1918 |
| Comparative | 27 | 24 | 27 | 24 | 0.02 | 1.1 | Round | — | — | 157 | 155 | 1621 |

TABLE 2-continued

| | Warp | | Weft | | Content of | Single | | | | Density of gray | | |
|---|---|---|---|---|---|---|---|---|---|---|---|---|
| | | Number | | Number | $TiO_2$ in | yarn | Shape of single yarn | | | fabric (yarns/inch) | | |
| | Fineness | of single | Fineness | of single | warp and | fineness | | Modification | | | | |
| | (dtex) | yarns | (dtex) | yarns | weft (%) | (dtex) | Shape | degree | FIG. | Warp | Weft | CF |
| Example 1 | | | | | | | | | | | | |
| Comparative Example 2 | 22 | 20 | 22 | 20 | 0.02 | 1.1 | Round | — | — | 160 | 160 | 1501 |
| Comparative Example 3 | 22 | 20 | 22 | 20 | 0.02 | 1.1 | Six-leaf | 1.4 | 13(a) | 160 | 160 | 1501 |
| Comparative Example 4 | 22 | 20 | 22 | 20 | 0.02 | 1.1 | Five-leaf | 1.6 | 14(a) | 160 | 160 | 1501 |
| Comparative Example 5 | 11 | 5 | 11 | 5 | 0.02 | 2.2 | Six-leaf | 1.6 | 13(a) | 264 | 198 | 1532 |
| Comparative Example 6 | 22 | 12 | 22 | 12 | 0.02 | 1.8 | Y | 3.5 | 14(b) | 160 | 160 | 1501 |
| Comparative Example 7 | 22 | 20 | 22 | 20 | 0.02 | 1.1 | Six-leaf | 1.4 | 13(a) | 144 | 132 | 1295 |
| Comparative Example 8 | 22 | 20 | 22 | 20 | 0.02 | 1.1 | Six-leaf | 1.4 | 13(a) | 190 | 130 | 1501 |
| Comparative Example 9 | 22 | 10 | 22 | 10 | 0.02 | 2.2 | Flat | 6.9 | 14(c) | 160 | 160 | 1501 |

TABLE 3

| | Density (yarns/inch) | | Cover factor | | Number of convex portions | Modification degree | Fitting ratio of single yarn | Laminating rate | Air permeability ($cm^3/cm^2 \cdot s$) |
|---|---|---|---|---|---|---|---|---|---|
| | Warp | Weft | Warp + Weft | Weft ratio | (portions) | | (%) | | |
| Example 1 | 180 | 161 | 1773 | 47.2 | 2-3 | 2.4 | 19.4 | 1.40 | 0.9 |
| Example 2 | 176 | 170 | 1623 | 49.1 | 4-6 | 1.5 | 16.5 | 0.67 | 0.7 |
| Example 3 | 163 | 145 | 1769 | 47.1 | 2-3 | 2.4 | 17.6 | 2.10 | 0.8 |
| Example 4 | 171 | 169 | 1594 | 49.7 | 4-6 | 1.4 | 10.4 | 1.40 | 0.7 |
| Example 5 | 176 | 170 | 1623 | 49.1 | 4-6 | 1.7 | 58.3 | 1.22 | 0.5 |
| Example 6 | 176 | 170 | 1623 | 49.1 | 6 | 1.5 | 21.4 | 0.40 | 0.7 |
| Example 7 | 176 | 170 | 1623 | 49.1 | 3-5 | 1.9 | 31.4 | 1.50 | 0.6 |
| Example 8 | 176 | 170 | 1623 | 49.1 | 3-4 | 2.1 | 30.0 | 0.88 | 0.7 |
| Example 9 | 176 | 170 | 1623 | 49.1 | 2-3 | 1.6 | 37.0 | 1.22 | 0.6 |
| Example 10 | 176 | 170 | 1623 | 49.1 | 2-3 | 2.2 | 16.1 | 0.50 | 0.7 |
| Example 11 | 147 | 127 | 2050 | 46.4 | 4-6 | 1.6 | 58.9 | 2.09 | 0.5 |
| Example 12 | 245 | 203 | 2101 | 45.3 | 4-6 | 1.5 | 60.6 | 1.00 | 0.5 |
| Comparative Example 1 | 180 | 161 | 1773 | 47.2 | 0 | — | 0 | 1.40 | 1.8 |
| Comparative Example 2 | 176 | 170 | 1623 | 49.1 | 0 | — | 0 | 0.82 | 0.8 |
| Comparative Example 3 | 176 | 170 | 1623 | 49.1 | 6 | 1.4 | 10.1 | 0.54 | 6.2 |
| Comparative Example 4 | 176 | 170 | 1623 | 90.1 | 4-5 | 1.6 | 0 | 1.22 | 0.8 |
| Comparative Example 5 | 290 | 210 | 1658 | 42.0 | 4-6 | 1.8 | 23.3 | 0 | 0.7 |
| Comparative Example 6 | 176 | 170 | 1623 | 49.1 | 4-6 | 3.7 | 16.1 | 0.50 | 0.7 |
| Comparative Example 7 | 158 | 140 | 1398 | 47.0 | 4-6 | 1.5 | 6.7 | 0.54 | 2.4 |
| Comparative Example 8 | 209 | 137 | 1623 | 39.6 | 4-6 | 1.5 | 8.3 | 0.67 | 0.9 |
| Comparative Example 9 | 176 | 170 | 1740 | 49.1 | 0 | 7.2 | 0 | 1.50 | 0.8 |

| | Number of yarns displaced (yarns) | Pull-out resistance of weft (mN) | Rating for leakage of down | Basis weight ($g/m^2$) | Tear strength Warp × Weft (N) | Reflection light of peak value | Half width at half maximum (degrees) |
|---|---|---|---|---|---|---|---|
| Example 1 | 0 | 647 | 4 | 48.9 | 9.9 × 9.4 | 73.71 | 22.0 |
| Example 2 | 0 | 620 | 5 | 30.8 | 13.9 × 11.6 | 78.32 | 19.5 |
| Example 3 | 0 | 578 | 4 | 49.0 | 9.9 × 9.1 | 74.90 | 22.1 |
| Example 4 | 0 | 597 | 4 | 43.1 | 8.1 × 8.0 | 75.85 | 22.1 |
| Example 5 | 0 | 637 | 4 | 30.8 | 13.9 × 10.9 | 78.55 | 19.2 |
| Example 6 | 0 | 640 | 3 | 30.8 | 10.2 × 8.2 | 77.90 | 19.9 |
| Example 7 | 0 | 521 | 5 | 30.8 | 12.9 × 9.8 | 77.01 | 20.5 |
| Example 8 | 0 | 620 | 5 | 30.8 | 11.9 × 10.3 | 76.10 | 21.0 |
| Example 9 | 0 | 502 | 5 | 30.8 | 13.7 × 10.7 | 81.50 | 17.1 |
| Example 10 | 0 | 601 | 5 | 30.8 | 10.0 × 10.0 | 73.78 | 21.9 |
| Example 11 | 0 | 738 | 5 | 68.0 | 24.0 × 15.0 | 75.85 | 20.9 |
| Example 12 | 0 | 1820 | 5 | 40.3 | 15.0 × 10.9 | 80.01 | 18.5 |
| Comparative Example 1 | 5 | 329 | 2 | 43.9 | 10.0 × 9.6 | 84.11 | 15.2 |
| Comparative Example 2 | 11 | 334 | 2 | 30.8 | 10.0 × 8.0 | 85.42 | 14.8 |
| Comparative Example 3 | 4 | 354 | 2 | 30.8 | 10.3 × 7.9 | 76.47 | 22.3 |
| Comparative Example 4 | 8 | 348 | 2 | 30.8 | 9.9 × 8.1 | 80.33 | 19.2 |
| Comparative Example 5 | 6 | 260 | 3 | 25.3 | 5.1 × 4.6 | 77.95 | 19.2 |
| Comparative Example 6 | 0 | 644 | 5 | 30.8 | 6.9 × 6.4 | 72.49 | 23.5 |
| Comparative Example 7 | 6 | 360 | 1 | 27.1 | 5.2 × 5.0 | 76.41 | 19.8 |
| Comparative Example 8 | 5 | 390 | 2 | 30.9 | 12.2 × 5.1 | 79.55 | 20.1 |
| Comparative Example 9 | 5 | 738 | 2 | 33.7 | 5.4 × 5.4 | 70.12 | 25.5 |

From the results described above, the woven fabric which is highly effective to prevent leakage of down is high in restoring force from a needle hole and yarn pull-out resistance. Such a woven fabric can be obtained when the ratio of the convex portion included, the laminating rate, and the shape of the single yarn (the number of convex portions, modification degree) in the woven fabric are within the scope of the present invention.

As for the woven fabrics in the Examples and Comparative Examples, an intensity of a reflected light was measured, and a half width at half maximum of the reflected light distribution was determined. The intensity of the reflected light of the woven fabric was measured using an automatic variable angle photometer (Goniophoto meter) GP-200 manufactured by Murakami Color Research Laboratory. As shown in FIG. 15, the sample 101 was exposed to light (incident light IL) at an incident angle IA of 45 degrees, and when the angle perpendicular to the incident light IL irradiated surface of the sample 101 was set to 0 degrees, the intensity of the reflected light RL was measured at a receiving angle RA in the range of −90 degrees to +90 degrees. The results are shown in Table 3.

As an example of the measurement of the sample 101, the measurement cases in Example 2, Comparative Examples 2 and 6 are shown. As shown in the measurement results of FIG. 16, a graph of the reflected light distribution was created with the receiving angle RA as the abscissa and the intensity of the reflected light RL as the ordinate, and the half width at half maximum of the reflected light distribution, which was in the range of the receiving angle RA of the reflected light RL of which the intensity became one-half of the peak value, was determined. Specifically, in Example 2, the peak value of the reflected light RL is 78.32, and the receiving angle RA of the intensity of the reflected light RL of which the intensity became one-half of the peak value becomes 39.16 is 27.7 degrees and 66.6 degrees. By a calculating formula of (66.6−27.7)/2, the half width at half maximum of the reflected light distribution of embodiment 2 is calculated with 19.5 degrees. The half widths at half maximum of the samples 101 are shown in Table 3. The woven fabrics in Example 2, Comparative Examples 2 and 6 that were dyed under the same condition using the same dye so as not to cause a difference in the optical characteristics by color were used.

From the above results, the optical characteristics of the woven fabric in Comparative Example 2 can be evaluated such that the woven fabric has metallic gloss and high-quality appearance. As described above, however, the woven fabric in Comparative Example 2 is less effective to prevent leakage of down. The woven fabric in Comparative Example 6 does not give high-class impression and has low appearance quality because of significant uneven gloss and a white blurred appearance (so-called white blurring). Meanwhile, although the woven fabric in Example 2 has less metallic gloss than that in Comparative Example 2, it has a little gloss unevenness and a few degrees of white blurring, so that it can be evaluated as a woven fabric having high appearance quality as the half width at half maximum is smaller than Comparative Example 6.

As described above, since the woven fabric 1 of the present invention contains the single yarn 10 having the convex portion 11 and the concave portion 12 in a cross section, the air permeability is 0.1 $cm^3/cm^2 \cdot s$ or more and 2.0 $cm^3/cm^2 \cdot s$ or less; the total fineness is 5 dtex or more and 80 dtex or less; the total cover factor of the warp and the weft is 1500 or more and 2200 or less; the ratio of the cover factor of the weft 3 of the total cover factor of the warp and the weft is 45% or more and 56% or less; a hole is formed in the woven fabric with a sewing machine needle having a cross-sectional diameter (thickness of a main body of the sewing machine needle) of 1.00 mm, and in an area having a radius of 1.5 mm about the hole, a total number of warps and wefts that are displaced by 0.08 mm or more with the sewing machine needle is 3 or less at 15 minutes after the sewing machine needle is pulled out from the woven fabric; and (i) the fitting ratio of single yarns is 10% or more and 80% or less, (ii) the laminating rate of the single yarn 10 is 0.4 or more and 3.0 or less, (iii) the number of the convex portions 11 of the single yarn 10 is 2 or more and 12 or less, (iv) the single yarn 10 has a modification degree of 1.2 or more and 3.0 or less, and (v) the concave portion of the single yarn has a depth of 0.6 μm or more and 8 μm or less. Therefore, even a woven fabric 1 having a low cover factor has an excellent effect of preventing leakage of down especially from a seam, so that a down-proof woven fabric 1 which is soft and lightweight can be easily obtained. This allows to provide products suitable for outdoor wear, sportswear, casual wear, and ticking.

REFERENCE SIGNS LIST

1: Woven fabric
2: Warp
3: Weft
4: Needle marked hole
5: Flat shaped portion of sewing machine needle
10: Single yarn
11: Convex portion
12: Concave portion
101: Sample
L1: Line showing a long diameter of single yarn 10
L2: Line connecting the center point of D1 with the concave portion 12 of the single yarn 10 which is the farthest from the center point of D1
D1: Diameter of the circle having line L1 as a diameter
D2: Diameter of the circle having line L2 as a radius
IL: Incident light
IA: Incident angle
RL: Reflected light
RA: Receiving angle

What is claimed is:

1. A woven fabric comprising a single yarn having a convex portion and a concave portion in a cross section, wherein an air permeability is 0.1 $cm^3/cm^2 \cdot s$ or more and 2.0 $cm^3/cm^2 \cdot s$ or less;

a total fineness is 5 dtex or more and 80 dtex or less;

a total cover factor of a warp and a weft is 1500 or more and 2200 or less;

a ratio of a weft cover factor of the total cover factor of the warp and the weft is 48% or more and 56% or less;

a hole is formed in the woven fabric with a sewing machine needle having a cross-sectional diameter (thickness of a main body of the sewing machine needle) of 1.00 mm, and in an area having a radius of 1.5 mm about the hole, a total number of warps and wefts that are displaced by 0.08 mm or more with the sewing machine needle is 3 or less at 15 minutes after the sewing machine needle is pulled out from the woven fabric; and the following characteristics (i) to (v) are provided:

(i) a fitting ratio of single yarns is 10% or more and 80% or less (ii) a laminating rate of the single yarn is 1.22 or more and 3.0 or less (iii) a number of convex portions of the single yarn is 2 or more and 12 or less (iv) the single yarn has a modification degree of 1.2 or more and 3.0 or less (v) a concave portion of the single yarn has a depth of 0.6 μm or more and 8 μm or less $$CF=CF_T+CF_W$$

where CF represents the total cover factor of the warp and the weft; $CF_T$ represents a cover factor of the warp; and $CF_W$ represents the cover factor of the weft.

2. The woven fabric according to claim 1, wherein a pull-out resistance of the weft is 450 mN or more.

3. The woven fabric according to claim 1, being subjected to calendering.

4. The woven fabric according to claim 1, wherein the single yarn contains 0.02% or more of titanium oxide.

5. A down product having the woven fabric as defined in claim 1, wherein the woven fabric is sewn with a machine sewing yarn made of a synthetic fiber having a total fineness of 100 dtex or more and 350 dtex or less.

6. The woven fabric according to claim 2, being subjected to calendering.

7. The woven fabric according to claim 2, wherein the single yarn contains 0.02% or more of titanium oxide.

8. The woven fabric according to claim 3, wherein the single yarn contains 0.02% or more of titanium oxide.

9. The woven fabric according to claim 6, wherein the single yarn contains 0.02% or more of titanium oxide.

10. A down product having the woven fabric as defined in claim 2, wherein the woven fabric is sewn with a machine sewing yarn made of a synthetic fiber having a total fineness of 100 dtex or more and 350 dtex or less.

11. A down product having the woven fabric as defined in claim 3, wherein the woven fabric is sewn with a machine sewing yarn made of a synthetic fiber having a total fineness of 100 dtex or more and 350 dtex or less.

12. A down product having the woven fabric as defined in claim 6, wherein the woven fabric is sewn with a machine sewing yarn made of a synthetic fiber having a total fineness of 100 dtex or more and 350 dtex or less.

13. A down product having the woven fabric as defined in claim 4, wherein the woven fabric is sewn with a machine sewing yarn made of a synthetic fiber having a total fineness of 100 dtex or more and 350 dtex or less.

14. A down product having the woven fabric as defined in claim 7, wherein the woven fabric is sewn with a machine sewing yarn made of a synthetic fiber having a total fineness of 100 dtex or more and 350 dtex or less.

15. A down product having the woven fabric as defined in claim 8, wherein the woven fabric is sewn with a machine sewing yarn made of a synthetic fiber having a total fineness of 100 dtex or more and 350 dtex or less.

16. A down product having the woven fabric as defined in claim 9, wherein the woven fabric is sewn with a machine sewing yarn made of a synthetic fiber having a total fineness of 100 dtex or more and 350 dtex or less.

* * * * *